US010814210B2

(12) United States Patent
Ritter

(10) Patent No.: US 10,814,210 B2
(45) Date of Patent: Oct. 27, 2020

(54) HEEL-LOCKING DEVICE FOR SNOW GLIDE BOARD BINDINGS

(71) Applicant: Spark R&D IP Holdings, LLC, Bozeman, MT (US)

(72) Inventor: William J. Ritter, Bozeman, MT (US)

(73) Assignee: Spark R&D IP Holdings, LLC, Bozeman, MT (US)

( * ) Notice: Subject to any disclaimer, the term of this patent is extended or adjusted under 35 U.S.C. 154(b) by 86 days.

(21) Appl. No.: 16/252,899

(22) Filed: Jan. 21, 2019

(65) Prior Publication Data

US 2019/0224560 A1 Jul. 25, 2019

Related U.S. Application Data

(60) Provisional application No. 62/621,534, filed on Jan. 24, 2018.

(51) Int. Cl.
*A63C 9/084* (2012.01)

(52) U.S. Cl.
CPC ..... *A63C 9/0847* (2013.01)

(58) Field of Classification Search
CPC ..... A63C 9/0647; A63C 5/031; A63C 9/081
See application file for complete search history.

(56) References Cited

U.S. PATENT DOCUMENTS

| | | | | |
|---|---|---|---|---|
| 2,433,161 | A | 12/1947 | Schwarze | |
| 2,705,150 | A | 3/1955 | Hansen | |
| 2,823,922 | A | 2/1958 | Berlenbach | |
| 2,879,071 | A | 3/1959 | King | |
| 3,630,539 | A | 12/1971 | Lusser | |
| 3,754,769 | A | 8/1973 | King | |
| 4,436,322 | A * | 3/1984 | Wittmann | A63C 9/02 280/614 |
| 5,697,631 | A | 12/1997 | Ratzek et al. | |
| 7,681,904 | B2 | 3/2010 | Ekberg | |
| 8,033,564 | B2 | 10/2011 | Riepler et al. | |
| 8,226,109 | B2 | 7/2012 | Ritter | |
| 8,328,225 | B2 | 12/2012 | Prigge et al. | |
| 8,469,372 | B2 | 6/2013 | Kloster et al. | |
| 8,544,869 | B2 | 10/2013 | Lehner | |
| 8,708,371 | B2 | 4/2014 | Balun | |
| 8,764,043 | B2 | 7/2014 | Neubauer et al. | |
| 9,022,412 | B2 | 5/2015 | Ritter | |
| 9,079,094 | B2 | 7/2015 | Eckberg | |
| 9,220,968 | B2 | 12/2015 | Ritter | |
| 9,573,043 | B2 | 2/2017 | Ritter | |
| 9,873,033 | B2 | 1/2018 | Debney | |

(Continued)

FOREIGN PATENT DOCUMENTS

| | | |
|---|---|---|
| EP | 2431080 B1 | 3/2014 |
| WO | 2007058719 A2 | 5/2007 |

*Primary Examiner* — John D Walters
*Assistant Examiner* — James J Triggs
(74) *Attorney, Agent, or Firm* — Stone Creek Services LLC; Alan M Flum

(57) ABSTRACT

A mechanism for locking the heel portion of a snow glide board boot binding. The heel-locking device locks and unlocks by rotating a lever. The heel-locking device allows the rider to lock their boot binding hands-free to the snow glide board by pressuring the back of the boot binding baseplate with their boot while the heel-locking device is in the locked position. Once locked, the rider must rotate the lever to a predetermined position to unlock the boot binding.

15 Claims, 24 Drawing Sheets

(56) References Cited

U.S. PATENT DOCUMENTS

| | | | | |
|---|---|---|---|---|
| 10,035,058 | B1 | 7/2018 | Ritter | |
| 2008/0122202 | A1 | 5/2008 | Furr et al. | |
| 2009/0072519 | A1 | 3/2009 | Hutchinson et al. | |
| 2009/0179403 | A1 | 7/2009 | Ekberg | |
| 2012/0061945 | A1* | 3/2012 | Korich ..... | A63C 9/001<br>280/617 |
| 2012/0274036 | A1 | 11/2012 | Kloster et al. | |

* cited by examiner

HEEL-LOCKING DEVICE FOR SNOW GLIDE BOARD BINDINGS

This application claims the benefit of U.S. Provisional Application No. 62/621,534, filed on Jan. 24, 2018. The entire contents of U.S. Provisional Application No. 62/621,534 are hereby incorporated by reference.

BACKGROUND

The present disclosure relates to a heel-locking device for splitboards and other snow glide boards. A splitboard is a snowboard separable into re-joinable skis.

Snowboarding is a recreational activity where a rider glides down a snow-covered mountain, hill, or slope while standing with their feet attached to a single snow glide board known as a snowboard. The concept is like snow skiing except both feet are attached to a single board.

Snowboard riders or "snowboarders" often share downhill slopes with skiers. Skiers and snowboarders often use ski lifts to access popular downhill slopes. Some snowboarders are interested in accessing downhill slopes in the backcountry away from crowded ski slopes and where the snow is fresh. However, climbing up mountains and slopes with thick fresh soft snow can be challenging.

Splitboards were developed to allow snowboarders access to the backcountry and areas not normally accessible to snowboarders. To climb uphill, or "tour," the backcountry, in "touring mode," the splitboard rider separates the splitboard into separate splitboard skis and uses them like cross-country skis. To ride downhill, in "riding mode," the splitboard rider rejoins the splitboard skis and rides the splitboard as they would an ordinary snowboard.

Boot bindings hold the splitboard rider's boots to the splitboard. In touring mode, one boot binding is attached to each splitboard ski like cross-country skis. In riding mode, the boot bindings are fastened across the splitboard skis and hold the splitboard skis together. In touring mode, the boot bindings are often locked in the front or toe portion of the splitboard skis and unlocked on the rear, or heel portion of the splitboard skis. The front of the splitboard bindings pivot to allow the splitboard rider to climb uphill more efficiently. Locking down the heel in touring mode allows the splitboard rider to adapt to diverse terrain. For example, side-stepping or traversing quick descents.

SUMMARY

The inventor devised a heel-locking device that allows the splitboard rider to quickly lock the heel of the splitboard binding. This heel-locking device allows the splitboard rider to flip a lever when they are ready to lock the heel. To lock the heel of the binding to the splitboard, the splitboard rider simply exerts pressure on the back of their heel against the heel-locking device. The boot binding baseplate will snap into place and lock to the splitboard ski. It will not unlock until a lever, that controls the locking and unlocking of the heel-locking device, is rotated to an unlocked position. The heel-locking device is designed so partial rotation of the lever will not unlock the boot. Alternatively, the splitboard rider can put their heel down when the heel-locking device is unlocked, crouch down and flip the lever to the locked position. In one embodiment, the heel-locking device is designed so partial rotation of the lever will not lock the boot while the heel-locking device is in the unlocked position. In another embodiment, the heel-locking device is designed so partial rotation of the lever will not lock the boot while in the unlocked position and also will not unlock the boot while in the locked position. To help facilitate this, the lever or the lock bar can be configured so the lever has an increase in resistance to movement as it rotates away from the first end of rotation followed by a decrease in resistance to movement as it continues to rotate toward the second end of rotation. In addition, the lever can have an increase in resistance to movement as it rotates away from a second end of rotation, followed by a decrease in resistance to movement as it rotates toward the first end of rotation.

This heel-locking device has several advantages. First, the splitboard rider does not need to crouch and flip the lever at the same time to engage it, which can be awkward. The heel-locking device can be foot activated once the lever is flipped to the locking position. Second, once locked, an accidental partial rotation of the lever will not unlock the boot binding. This increases safety. Third, the splitboard rider has the option to lock the heel-locking device by placing the heel down while the lever is unlocked and then rotating the lever to lock. This may be appropriate in situations where stomping down the heel of the boot binding could be dangerous. Fourth, the heel-locking device has a forward release. If the splitboard rider falls forward hard enough, the locking bar will deflect upward and release the heel. This release force is tailored to only release in a fall, not in use while the splitboard rider is in control. Fifth, in the unlocked position, an accidental partial rotation of the lever will not lock the boot binding. This allows the user to tour with an uninterrupted stride.

This Summary introduces a selection of concepts in simplified form described in more detail in the Description. The Summary is not intended to identify essential features or limit the scope of the claimed subject matter.

DRAWINGS

DESCRIPTION

The terms "top, "bottom," "upper," "front," and "back," are relative terms used throughout to help the reader understand the figures. Unless otherwise indicated, these do not denote absolute direction or orientation and do not imply a preference. When describing the figures, the terms "top," "bottom," "front," "rear," are from the perspective of how a typical splitboard rider would view the splitboard or components while standing on the board in a conventional riding or touring position. Specific dimensions should help the reader understand the scale and advantage of the disclosed material. Dimensions given are typical and the claimed invention is not limited to the recited dimensions. The figures are not necessarily to scale.

Certain features or components and some details of conventional elements may not be shown in the interest of clarity, explanation, and conciseness. For example, one splitboard ski is illustrated rather than two. For clarity, only the boot binding baseplate is illustrated, rather than the full boot binding. Splitboards or snowboards may include hardware associated with the bindings such as pucks, tracks, sliders, and climbing bars. These parts are also omitted for clarity. In the present disclosure, they represent part of the environment and one of ordinary skill in the art readily knows how to apply them to a splitboard or snowboard.

Referring to similarly named part with an ordinal prefix such as first, second, or third helps distinguish the parts from one another when referred to together. This implies no preference of one part over the other. Similarly, referring to examples or embodiments using prefixes such as "first," "second," "third," or "alternative," does not infer any preference of one example or embodiment over the other.

Figure 1:
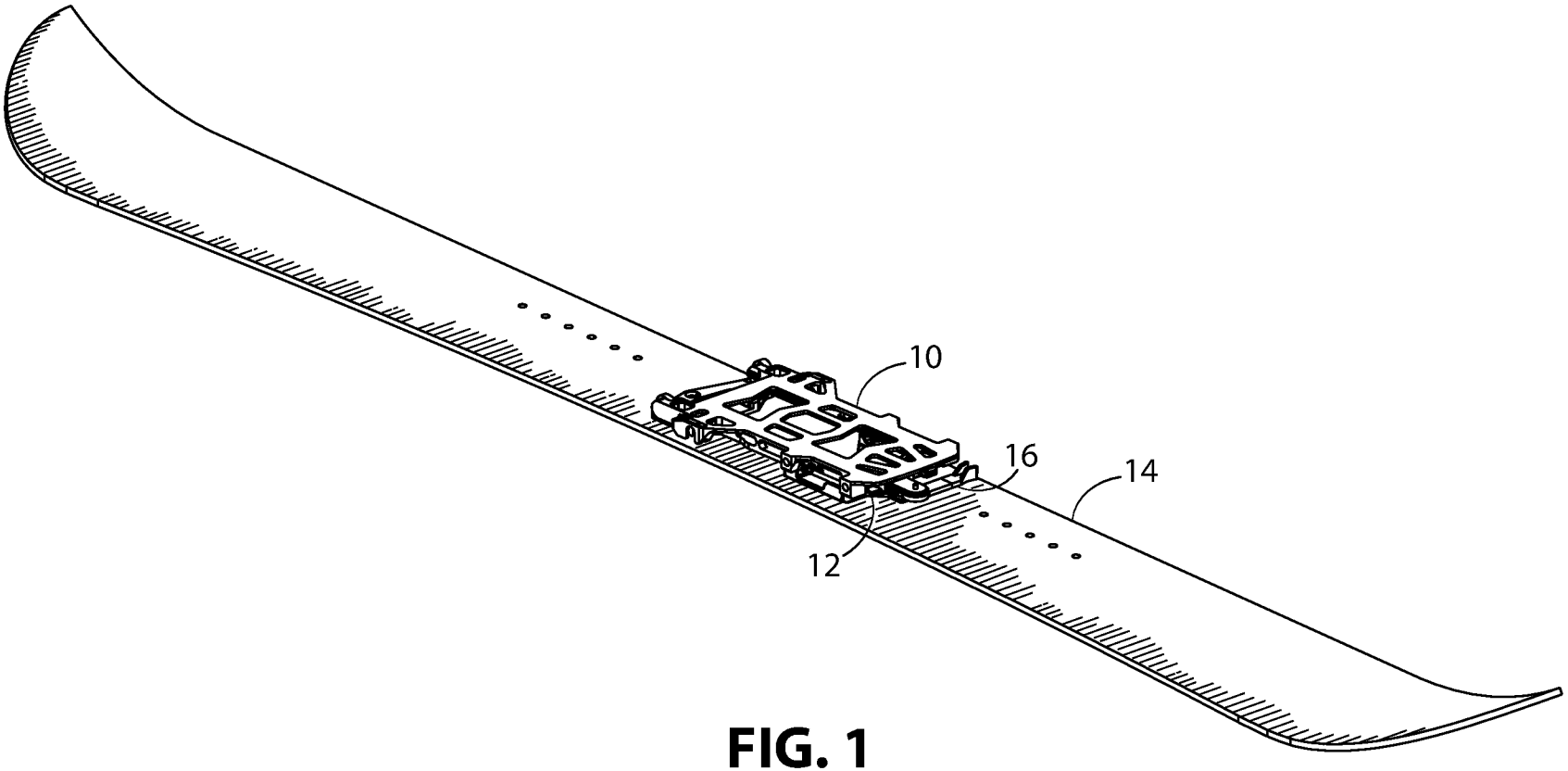
FIG. 1 illustrates, in top perspective view, a boot binding baseplate with a heel-locking assembly attached to a splitboard ski.
Figure 2:
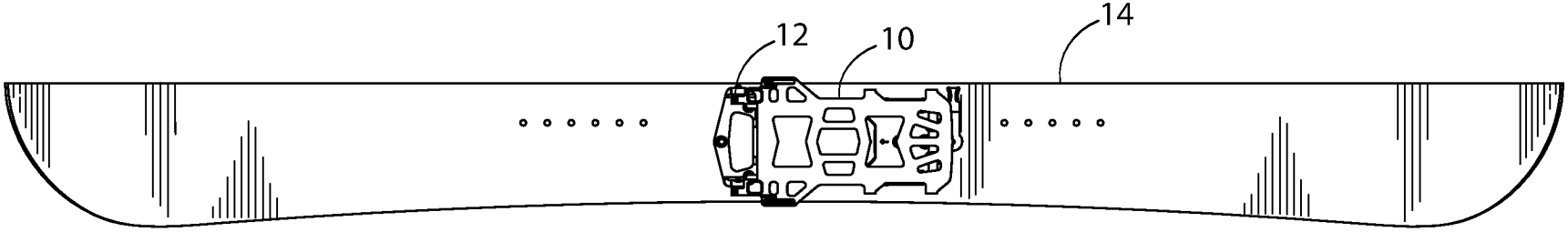
FIG. 2 illustrates the boot binding baseplate, the heel-locking assembly, and splitboard ski of FIG. 1 in top view.
Figure 3:
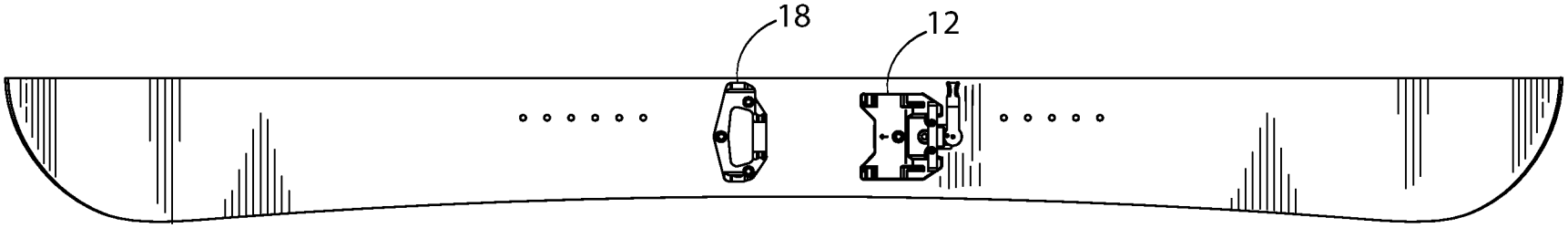
FIG. 3 illustrates, in top view, the system of FIG. 2 with the boot binding baseplate removed to show the heel-locking system and a mounting bracket.
Figure 4:
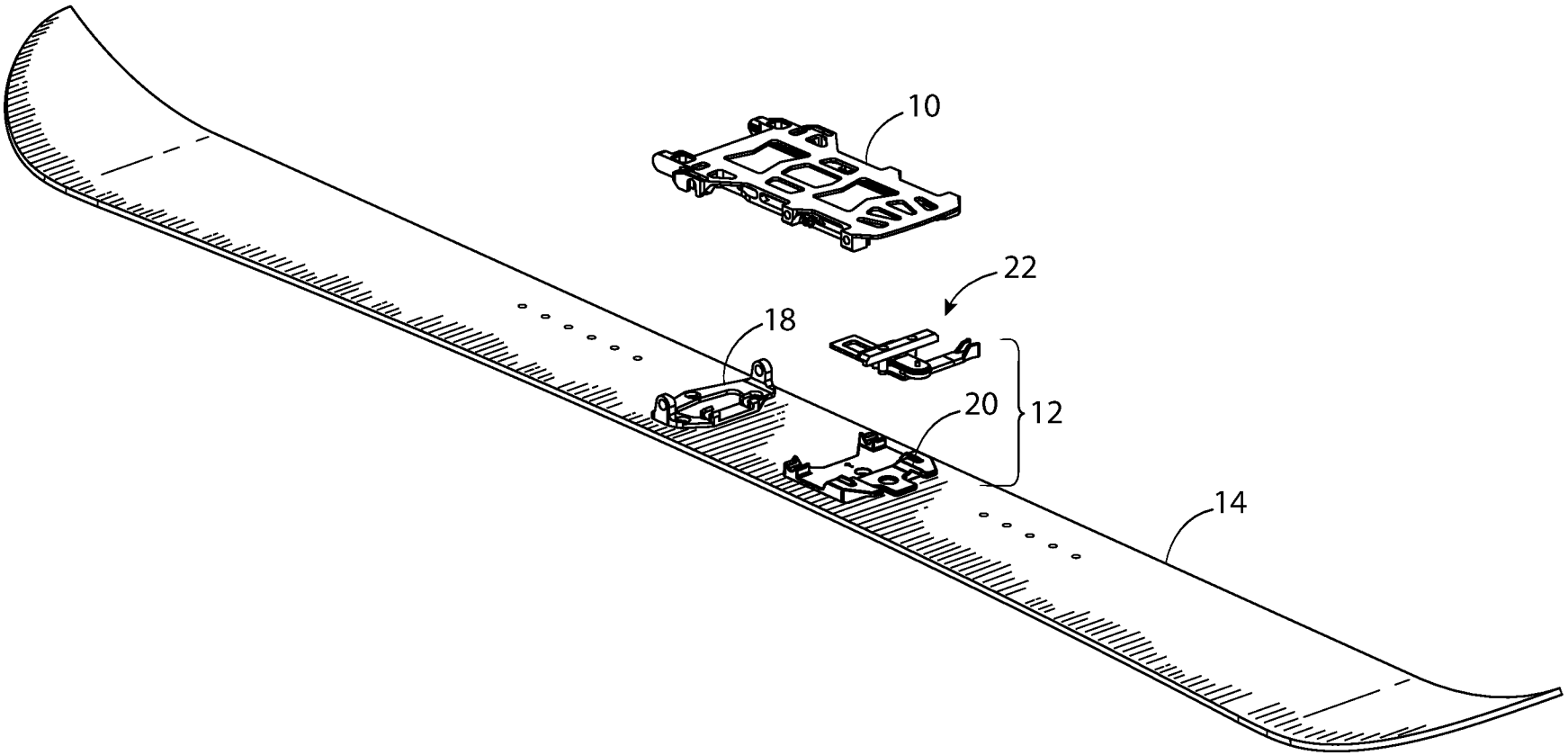
FIG. 4 illustrates the system of FIG. 1 in partially exploded view showing the boot binding baseplate, mounting bracket, heel rest, and heel-locker subassembly.

The Description refers to figures, where like numerals refer to like elements throughout the several views, where FIG. 1 illustrates, in top perspective view, a boot binding baseplate 10 with a heel-locking assembly 12 attached to a splitboard ski 14. The lever 16 is in the full locked position. FIG. 2 illustrates the boot binding baseplate 10, the heel-locking assembly 12, and splitboard ski 14 of FIG. 1 in top view. FIG. 3 illustrates, in top view, the system of FIG. 2 with the boot binding baseplate 10 removed to show the heel-locking assembly 12 and a mounting bracket 18. FIG. 4 illustrates the system of FIG. 1 in partially exploded view showing the boot binding baseplate 10, mounting bracket 18, heel rest 20, and a heel-locker subassembly 22. The heel rest 20 and the heel-locker subassembly 22 comprise the heel-locking assembly 12. Both the mounting bracket 18 and the heel rest 20 are secured to the splitboard ski 14. They are typically secured to the splitboard ski 14 by fasteners, such as threaded fasteners.

Figure 5:
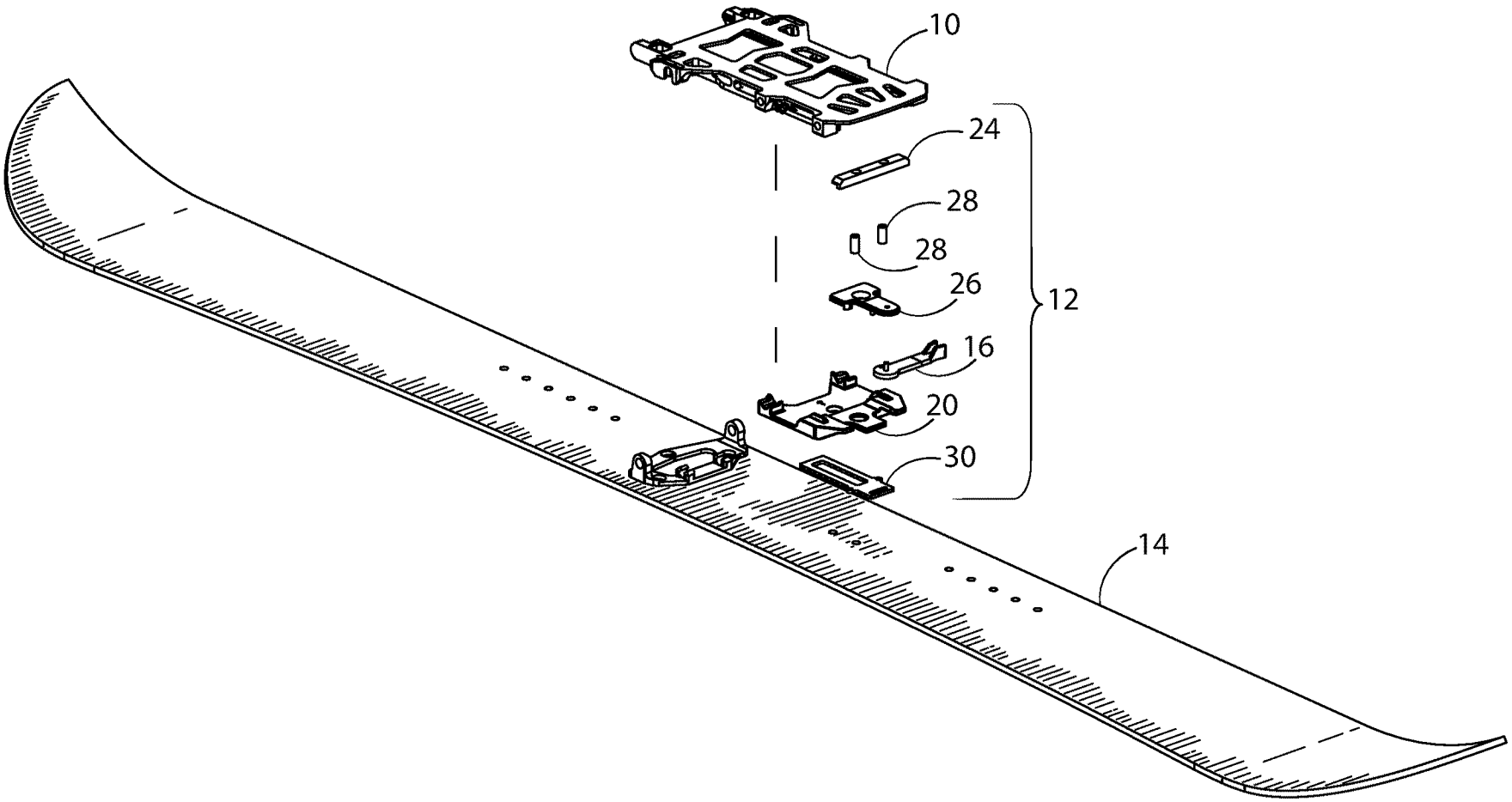
FIG. 5 illustrates the system of FIG. 1 in exploded view.
Figure 6:
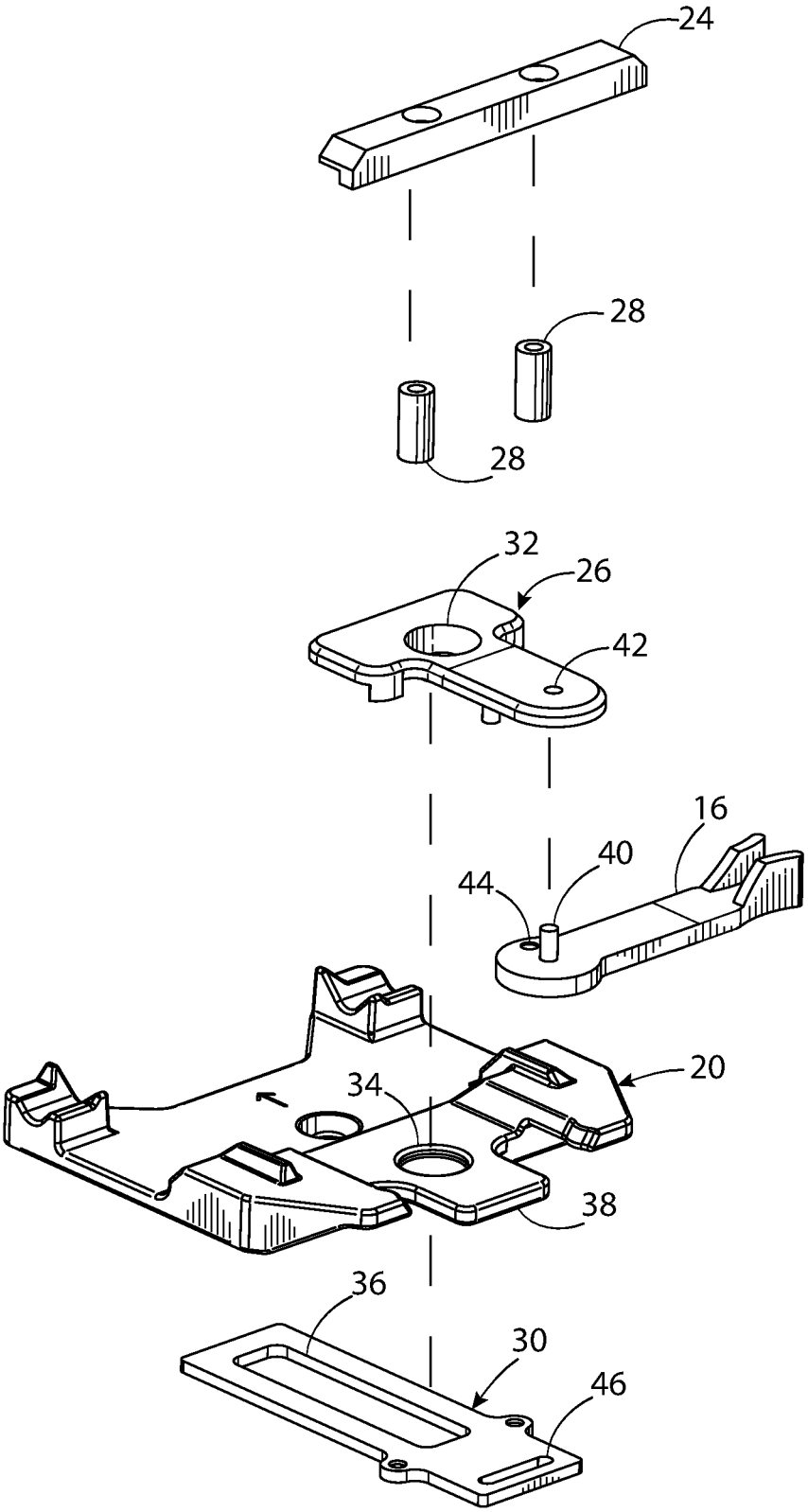
FIG. 6 illustrates an exploded view of the heel-locking assembly.

FIG. 5 illustrates an exploded view of the heel-locking assembly 12, exploded away from the splitboard ski 14 and the boot binding baseplate 10. The heel-locking assembly 12 can include a lock bar 24, a lock plate 26, spacers 28, slotted bracket 30, the lever 16, and heel rest 20. Referring to FIGS. 5 and 6, threaded fasteners (not illustrated) secure the lock bar 24 to the slotted bracket 30 through the spacers 28. These are secured to the splitboard ski 14 (FIG. 5) by a threaded fastener (not illustrated) through apertures 32, 34, and through slot 36 in the lock plate 26, heel rest 20, and the slotted bracket 30, respectively. The aperture 34 extends through a lip 38 in the heel rest 20. The lip 38 is elevated above the splitboard ski 14 (FIG. 5) to allow it to slide. The lever 16 includes a pin 40, or a projection, projecting upward from the lever 16 and into an aperture 42 in the lock plate 26. A pin 44 (partially hidden from view) projects downward from the lever 16 and into a pin-engaging slot 46 in the slotted bracket 30. As the lever 16 turns, the pin 44 engages the pin-engaging slot 46. Because the pin 44, is offset (i.e., not in the center of the axis of rotation like pin 40), as it moves along the pin-engaging slot 46, it either pushes or pulls the slotted bracket 30. Because the slotted bracket 30 and the lock bar 24 are rigidly connected, both the slotted bracket 30 and the lock bar 24 will move as the lever 16 is turned.

Figure 7:
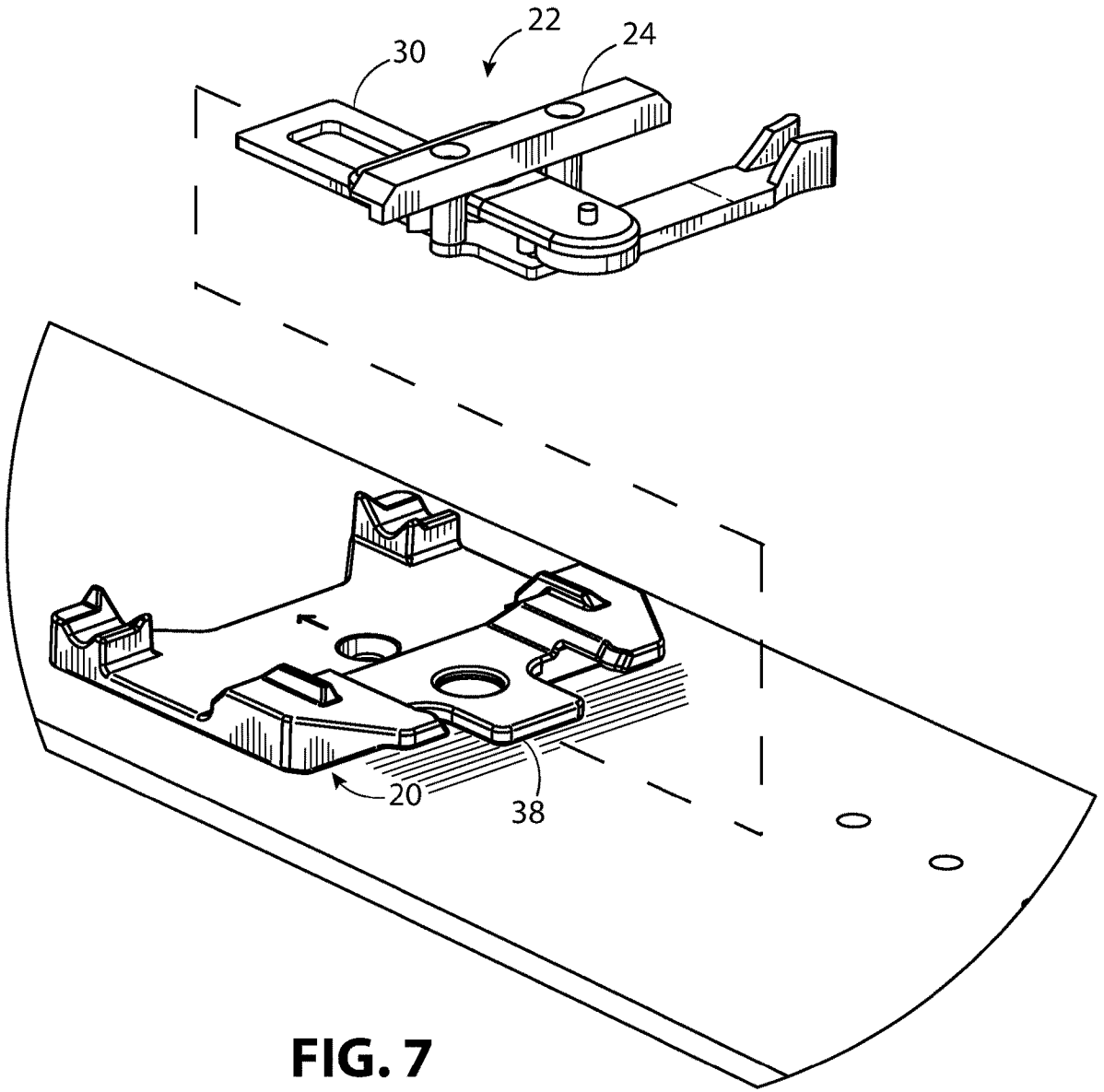
FIG. 7 illustrates an enlarged partial view of FIG. 4 showing the heel rest and heel-locker subassembly.

FIG. 7 illustrates an enlarged partial view of FIG. 4 showing the heel rest 20 and heel-locker subassembly 22 with the lock bar 24 rigidly connected to the slotted bracket 30. The slotted bracket 30, as illustrated by the broken lines, slides under the lip 38.

Figure 8:
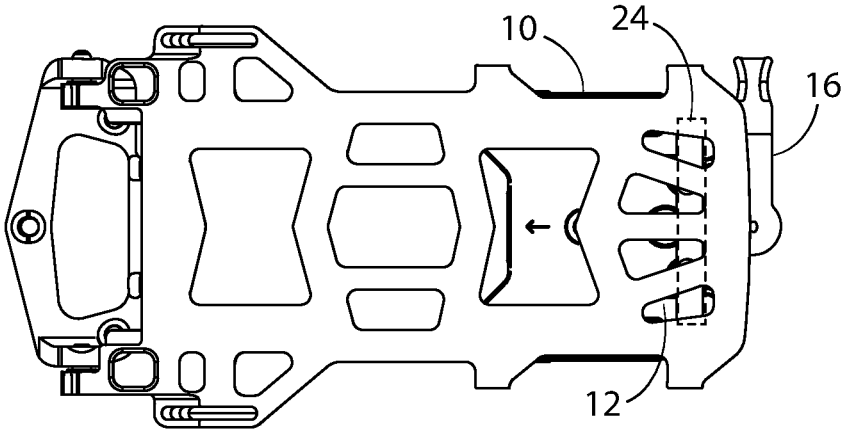
FIG. 8 illustrates, in top view, the boot binding baseplate with the heel-locking assembly, where the lock bar is adjusted to the fully locked position.
Figure 9:
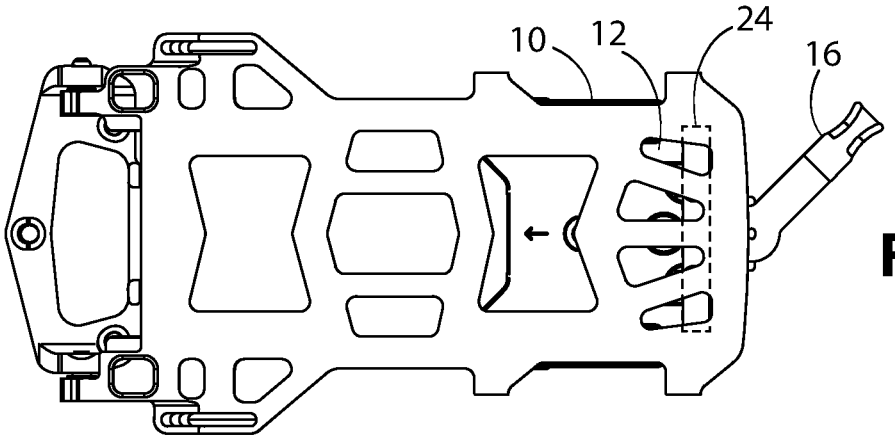
FIG. 9 illustrates, in top view, the boot binding baseplate with the heel-locking assembly, with the lock bar rotated 45° from the fully locked position of FIG. 8, but still locked.
Figure 10:
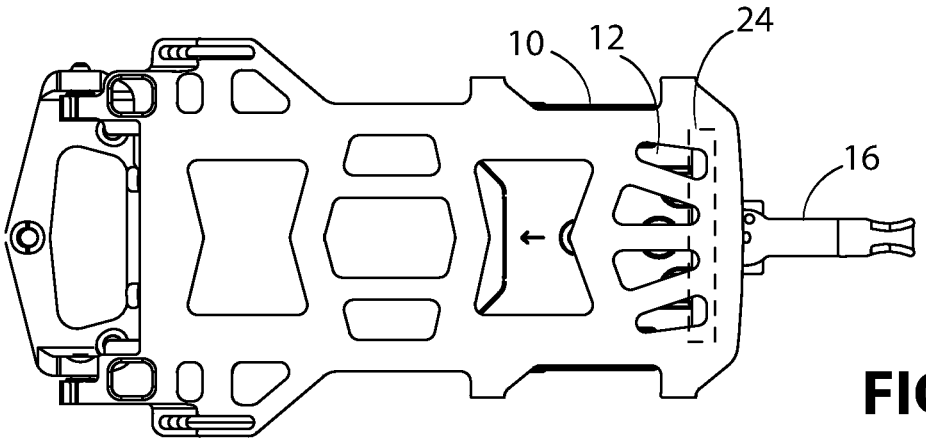
FIG. 10 illustrates, in top view, the boot binding baseplate with the heel-locking assembly, in an unlocked position, with the lock bar rotated 90° from the fully locked position of FIG. 8.
Figure 11:
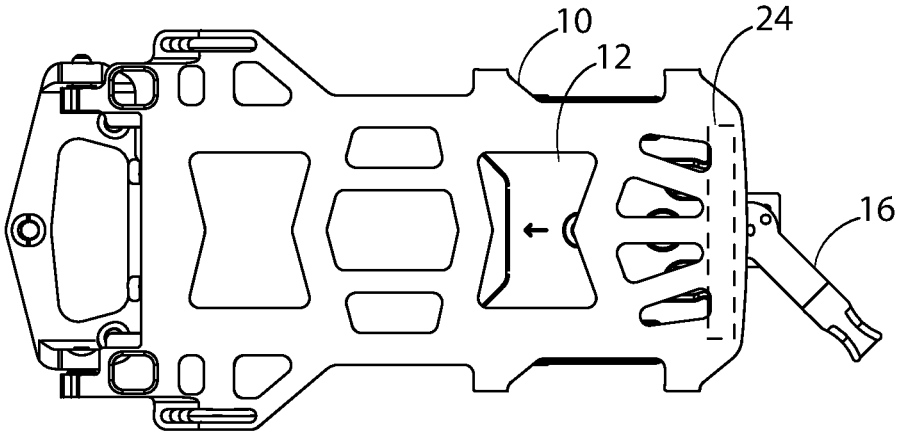
FIG. 11 illustrates, in top view, the boot binding baseplate with the heel-locking assembly, in an unlocked position, with the lock bar rotated 135° from the fully locked position of FIG. 8.
Figure 12:
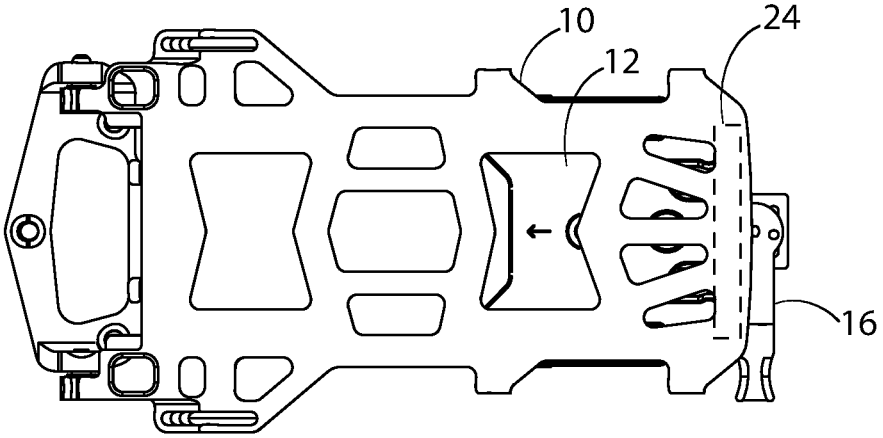
FIG. 12 illustrates, in top view, the boot binding baseplate with the heel-locking assembly, in an unlocked position, with the lock bar rotated 180° from the fully locked position of FIG. 8.
Figure 13:
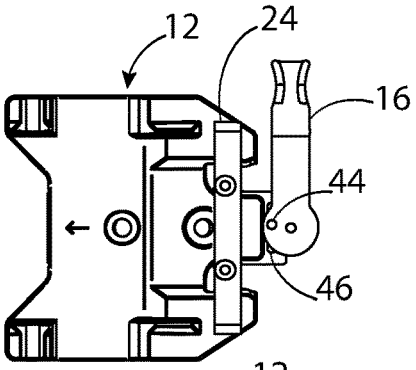
FIG. 13 illustrates, in top view, the heel-locking assembly of FIG. 8 with the boot binding baseplate removed in the fully locked position.
Figure 14:
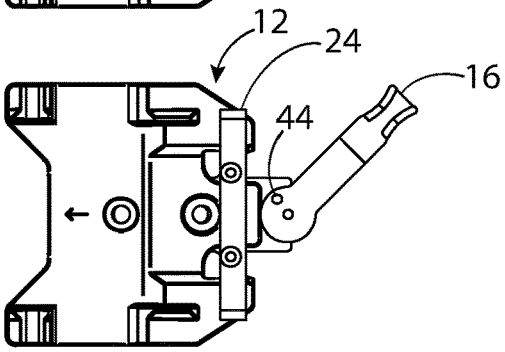
FIG. 14 illustrates, in top view, the heel-locking assembly of FIG. 13 with the lock bar rotated 45° from the fully locked position.
Figure 15:
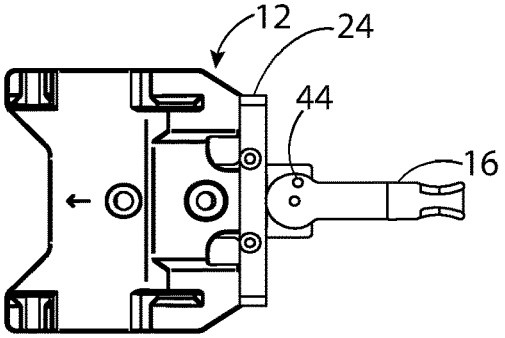
FIG. 15 illustrates, in top view, the heel-locking assembly of FIG. 13 with the lock bar rotated 90° from the fully locked position.
Figure 16:
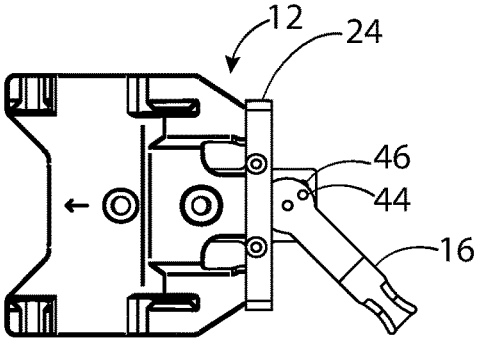
FIG. 16 illustrates, in top view, the heel-locking assembly of FIG. 13 with the lock bar rotated 135° from the fully locked position.
Figure 17:
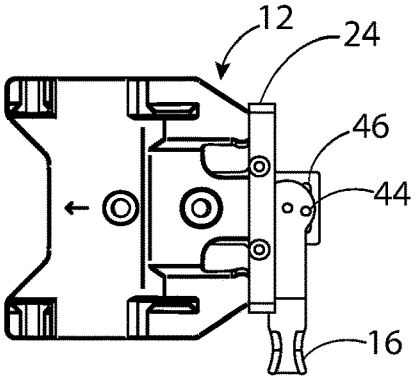
FIG. 17 illustrates, in top view, the heel-locking assembly of FIG. 13 with the lock bar rotated 180° from the fully locked position.

FIGS. 8-12 illustrate, in top view, the boot binding baseplate 10 with the heel-locking assembly 12 with lock bar 24 adjusted from fully locked in FIG. 8 to fully unlocked in FIG. 12. The lock bar 24 is shown in dashed lines representing that it is mostly hidden from view. Starting from the fully locked position in FIG. 8, the lever 16 is rotated clockwise 45° in FIG. 9, 90° in FIG. 10, 135° in FIG. 11, and 180° in FIG. 12 all regarding the fully locked position. As the lever 16 turns clockwise, the lock bar 24 moves toward the back edge of the boot binding baseplate 10. The linear travel of the lock bar 24 can be set so the lever 16 must be in a predetermined position for the boot binding baseplate to unlock. For example, the predetermined position could be set past the 45° degree position to prevent accidental unlocking. While the sequence illustrated goes from fully locked in the full counterclockwise position to fully unlocked in the full clockwise position, the heel-locking assembly 12 can be designed to operate in the opposite sequence (i.e., rotating counterclockwise unlocks rather than locks. For example, the splitboard ski 14 illustrated throughout this disclosure is a left ski. The sequence illustrated in FIGS. 8-12 is convenient for use on a left ski. The reverse sequence would typically be convenient for use on the right ski.

FIGS. 13-17 illustrate, in top view, the heel-locking assembly 12 of FIGS. 8-12 with the boot binding baseplate 10 removed. This shows the relationship between lever 16, pin 44, pin-engaging slot 46, and lock bar 24 as the lever 16 goes through its range of motion. The pin-engaging slot 46 is hidden from view in FIGS. 14 and 15.

Figure 18:
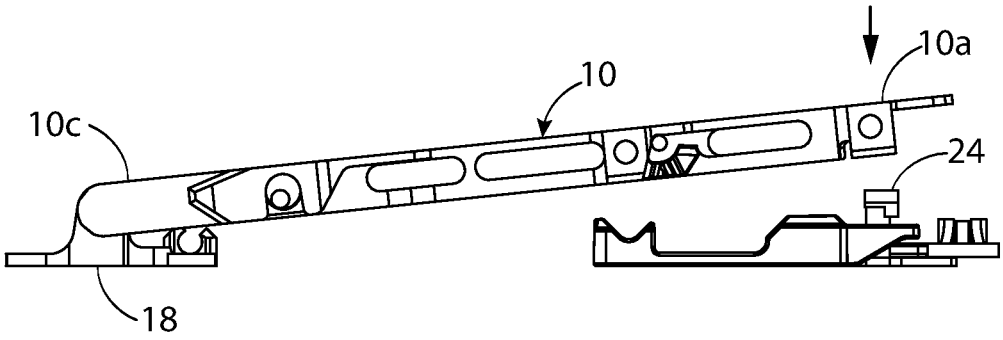
FIG. 18 illustrates, in side view, the boot binding baseplate with the heel-locking assembly unlocked, with the boot binding baseplate rotating toward the heel-locking assembly.
Figure 19:
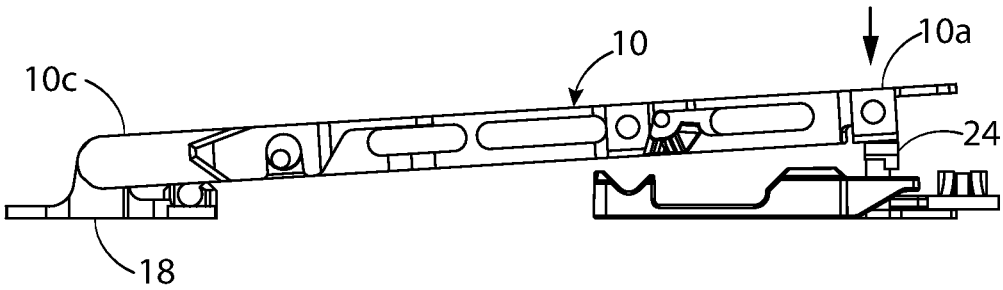
FIG. 19 illustrates, in side view, the boot binding baseplate with the heel-locking assembly unlocked, with the boot binding baseplate resting against the heel-locking assembly, with the lock bar in the locked position.
Figure 20:
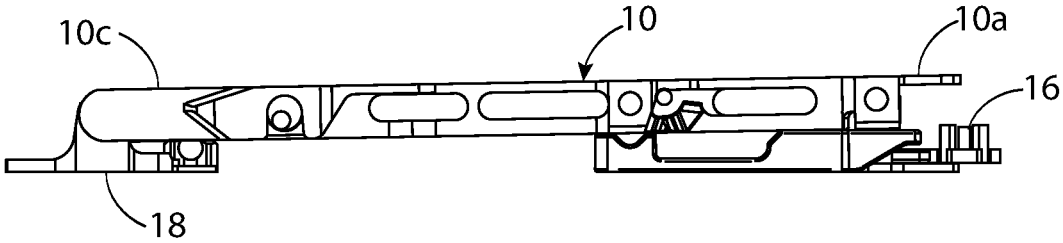
FIG. 20 illustrates, in side view, the boot binding baseplate locked to the heel-locking assembly by applying pressure against the boot binding baseplate.
Figure 21:
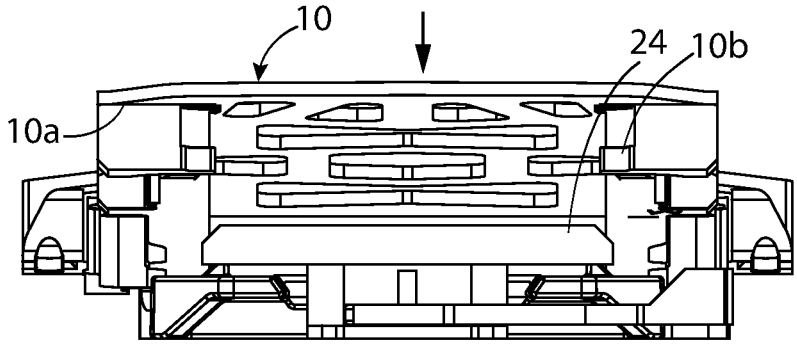
FIG. 21 illustrates, in back view, the boot binding baseplate with the heel-locking assembly configured as in FIG. 18.
Figure 22:
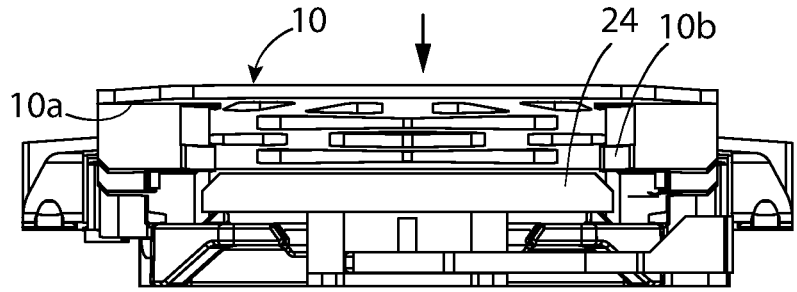
FIG. 22 illustrates, in back view, the boot binding baseplate with the heel-locking assembly configured as in FIG. 19.
Figure 23:
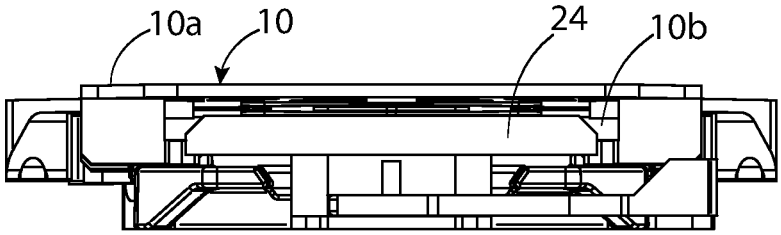
FIG. 23 illustrates, in back view, the boot binding baseplate with the heel-locking assembly configured as in FIG. 20.

FIGS. 18-23 illustrate, in side view (FIGS. 18-20), and back view (FIGS. 21-23) how the locking mechanism is engaged by applying downward force on the heel end 10*a* of the boot binding baseplate 10. In FIGS. 18-20, the toe end 10*c* of the boot binding baseplate 10 pivots about the mounting bracket 18. FIGS. 18 and 21 show the lock bar 24 free of the boot binding baseplate 10. The boot binding baseplate 10 includes an inwardly-flanged lip 10*b* shown in FIGS. 21-23. Referring to FIGS. 19 and 23, with the lock bar 24 in the locked position, the inwardly-flanged lip 10*b* is impeded by the top of the lock bar 24. Referring to FIG. 22, the lock bar 24 includes a beveled edge. The lock bar 24 is made of a material that flexes when pressure is applied such as nylon or plastic. The boot binding baseplate 10 is typically made of aluminum or other metal. Referring to FIG. 23, when the splitboard rider can press down their heel with sufficient force to cause the lock bar 24 to slightly deform and cause the inwardly-flanged lip 10*b* to slip under the lock bar 24.

Figure 24:
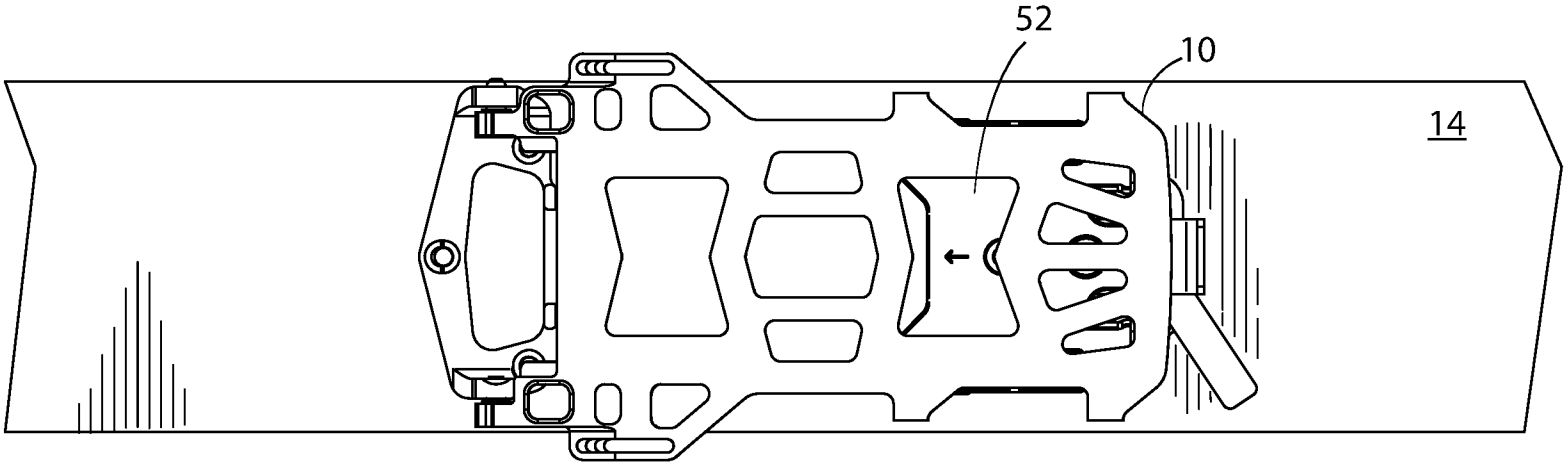
FIG. 24 illustrates, in top view, an alternative example of a heel-locking assembly showing the boot binding baseplate and a portion of a splitboard ski.
Figure 25:
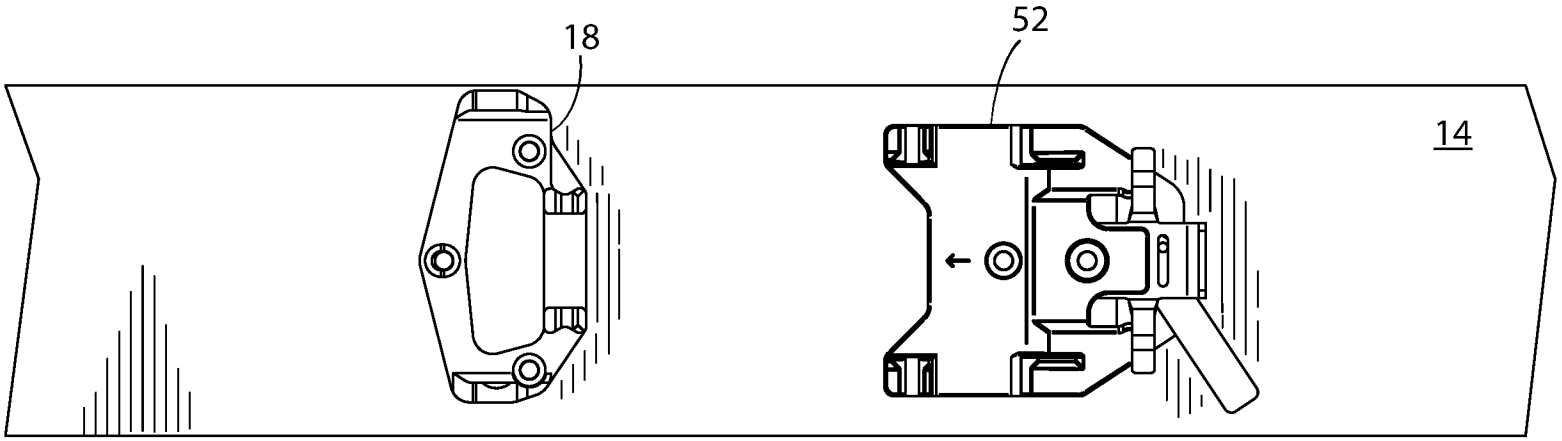
FIG. 25 illustrates, the alternative example of the heel-locking assembly of FIG. 24 with the boot binding baseplate removed to reveal the heel-locking assembly and a mounting bracket.
Figure 26:
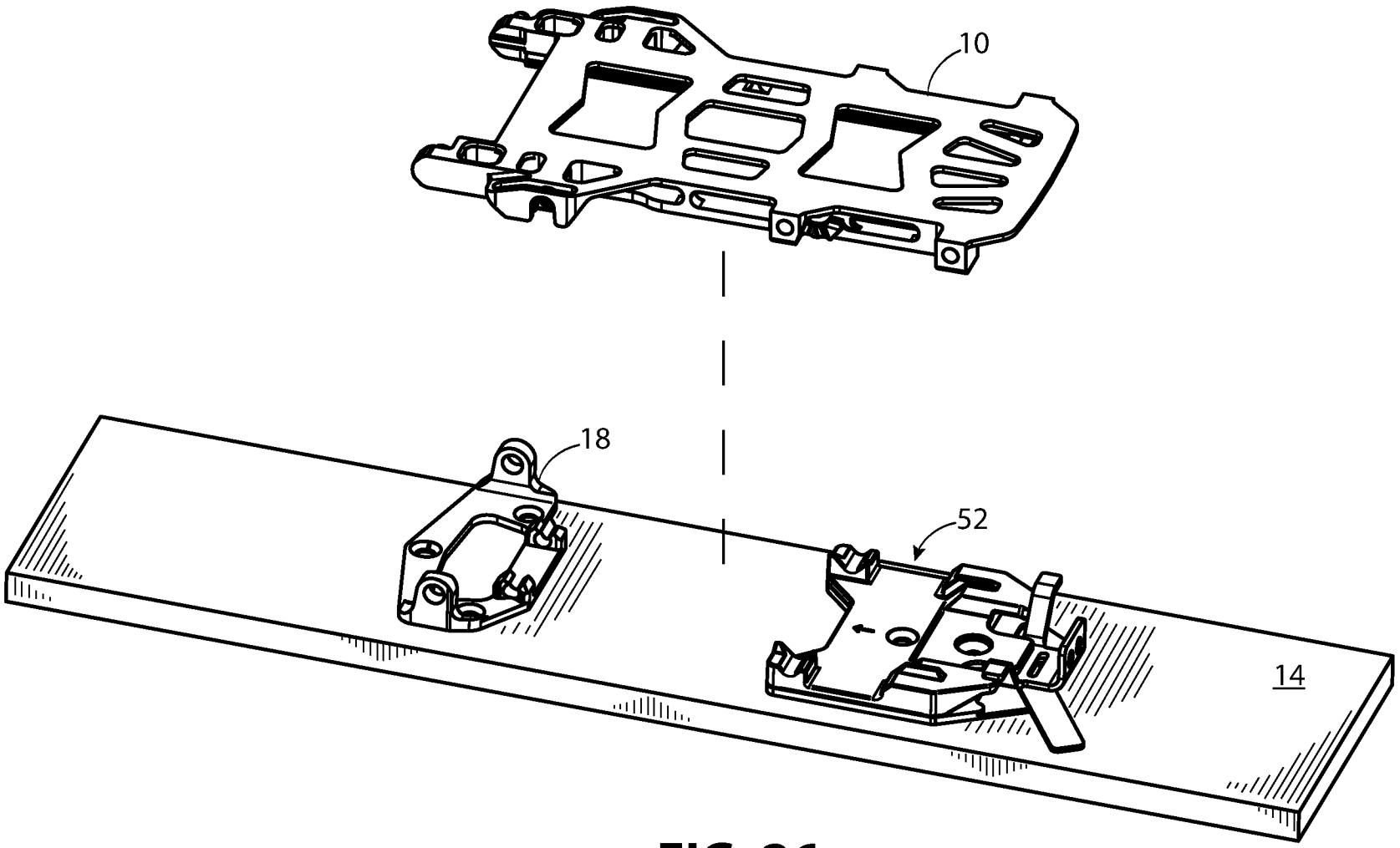
FIG. 26 illustrates, a partially exploded perspective view of FIG. 24 showing the boot binding baseplate exploded away from the splitboard, locking assembly, and mounting bracket.
Figure 27:
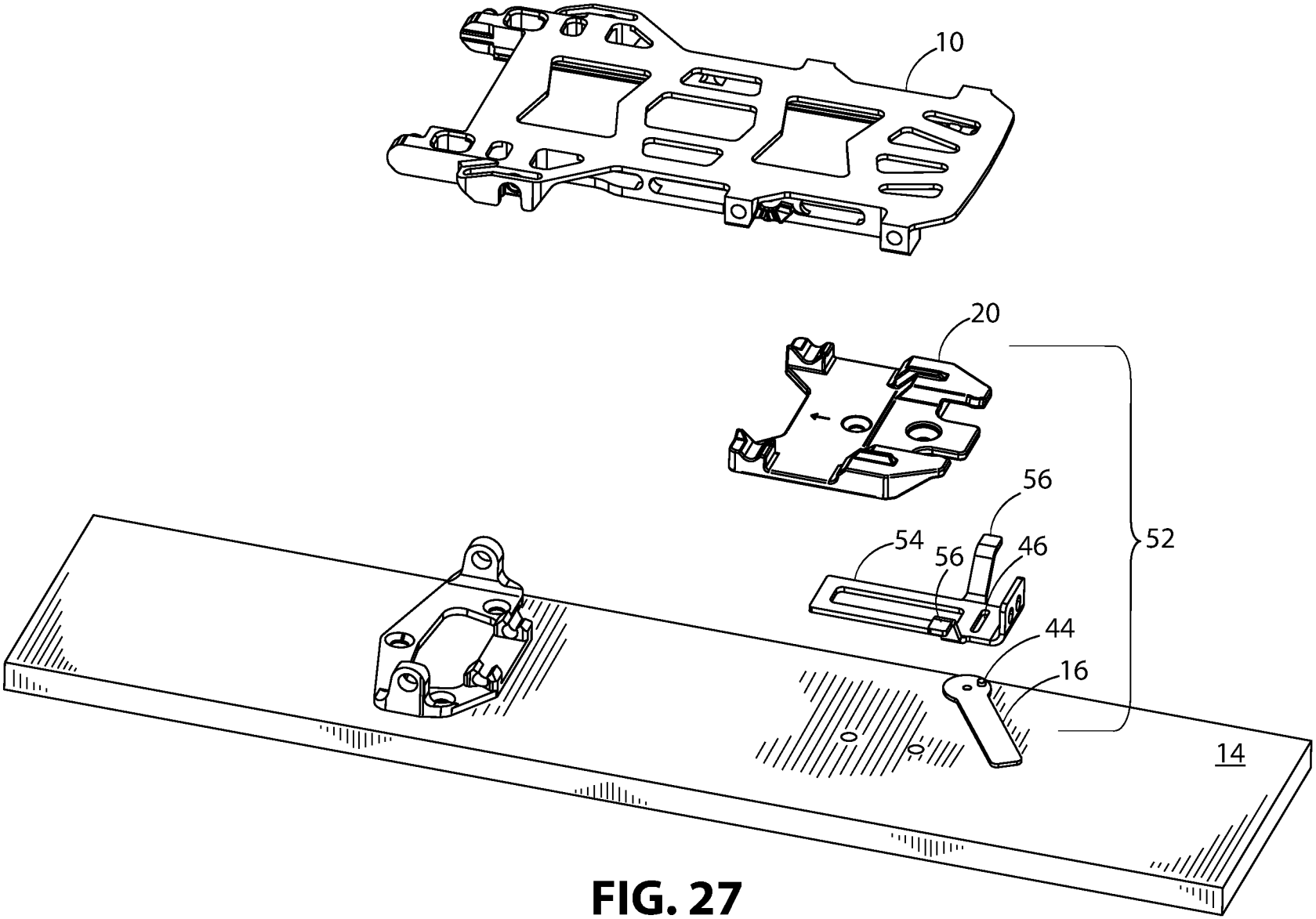
FIG. 27 illustrates, a partially exploded perspective view of FIG. 24 showing, the boot binding baseplate, slotted bracket, lever, and heel rest, exploded away from the heel-locking assembly.

FIGS. 24-27 illustrate an alternative example of a heel-locking assembly 52 showing the boot binding baseplate 10 (except FIG. 25), and a portion of a splitboard ski 14. FIG. 25 illustrates, the alternative example of the heel-locking assembly 52 of FIG. 24 with the boot binding baseplate 10 of FIG. 24 removed to reveal the heel-locking assembly 52 and a mounting bracket 18. FIG. 26 illustrates, a partially exploded perspective view of FIG. 24 showing the boot binding baseplate 10 exploded away from the splitboard ski 14, heel-locking assembly 52, and mounting bracket 18. FIG. 27 illustrates, a partially exploded perspective view of FIG. 24 showing, the boot binding baseplate 10, lever 16, slotted bracket 54, and heel rest 20, exploded away from the heel-locking assembly 52. Operation is like the heel-locking assembly 12 of FIGS. 1-23. A pin 44 engages a pin-engaging slot 46 extending laterally across the slotted bracket 54. The force from the pin causes the slotted bracket 54 to move toward and away from the heel side of the boot binding baseplate 10. Wings 56 extending upward and outward from the slotted bracket 54 replace the lock bar 24 of the heel-locking assembly 12 of FIGS. 1-23.

Figure 28:
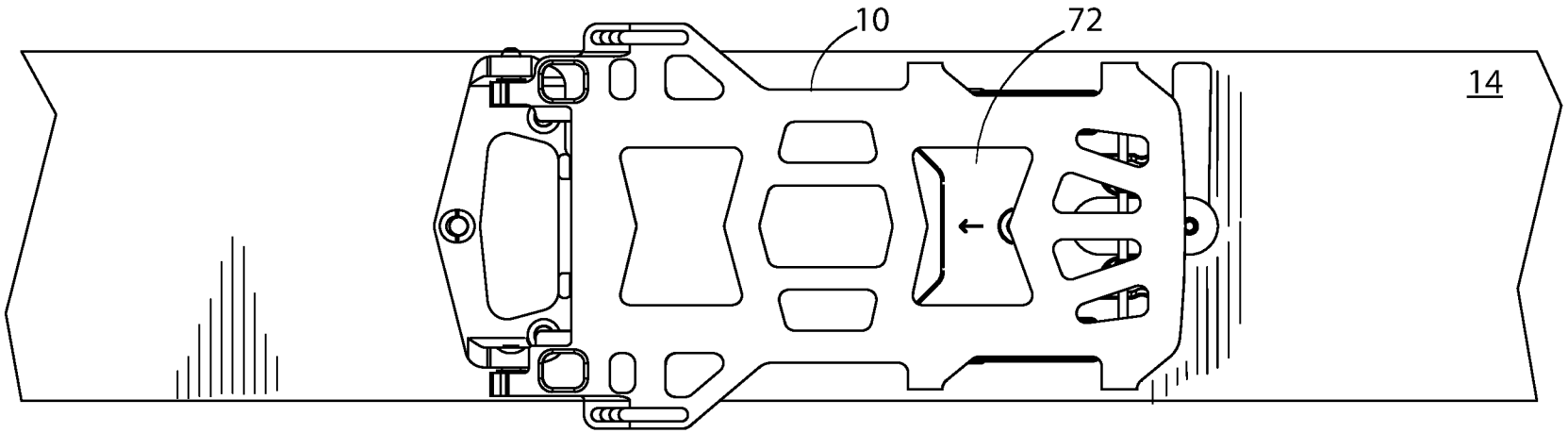
FIG. 28 illustrates, another example of a heel-locking assembly showing the boot binding baseplate and a portion of a splitboard ski.
Figure 29:
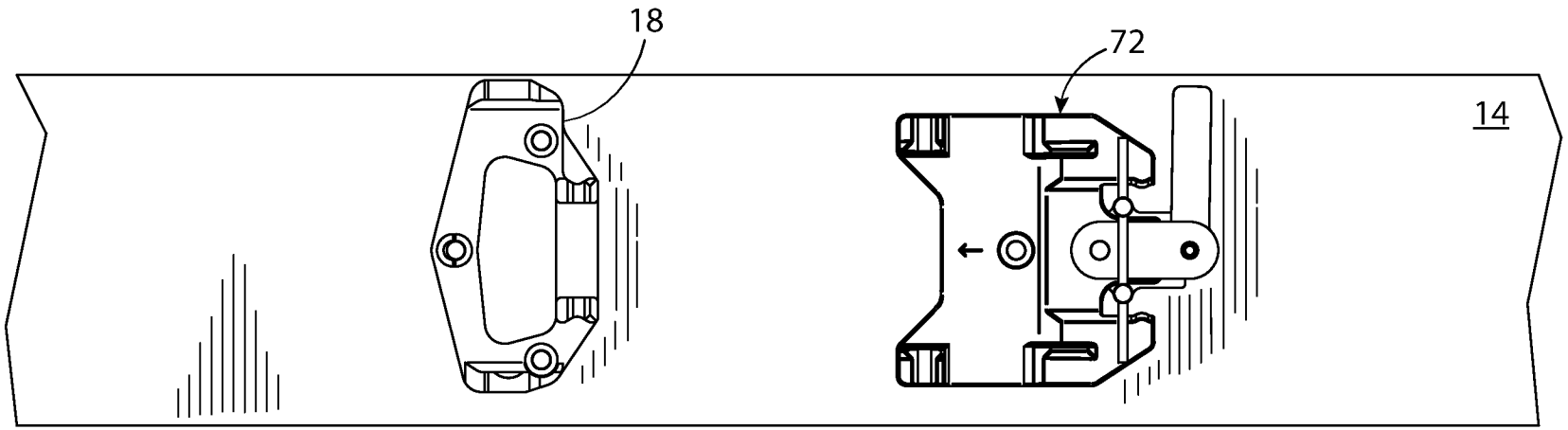
FIG. 29 illustrates, the alternative example of the heel-locking assembly of FIG. 28 with the boot binding baseplate removed to reveal the heel-locking assembly and a mounting bracket.
Figure 30:
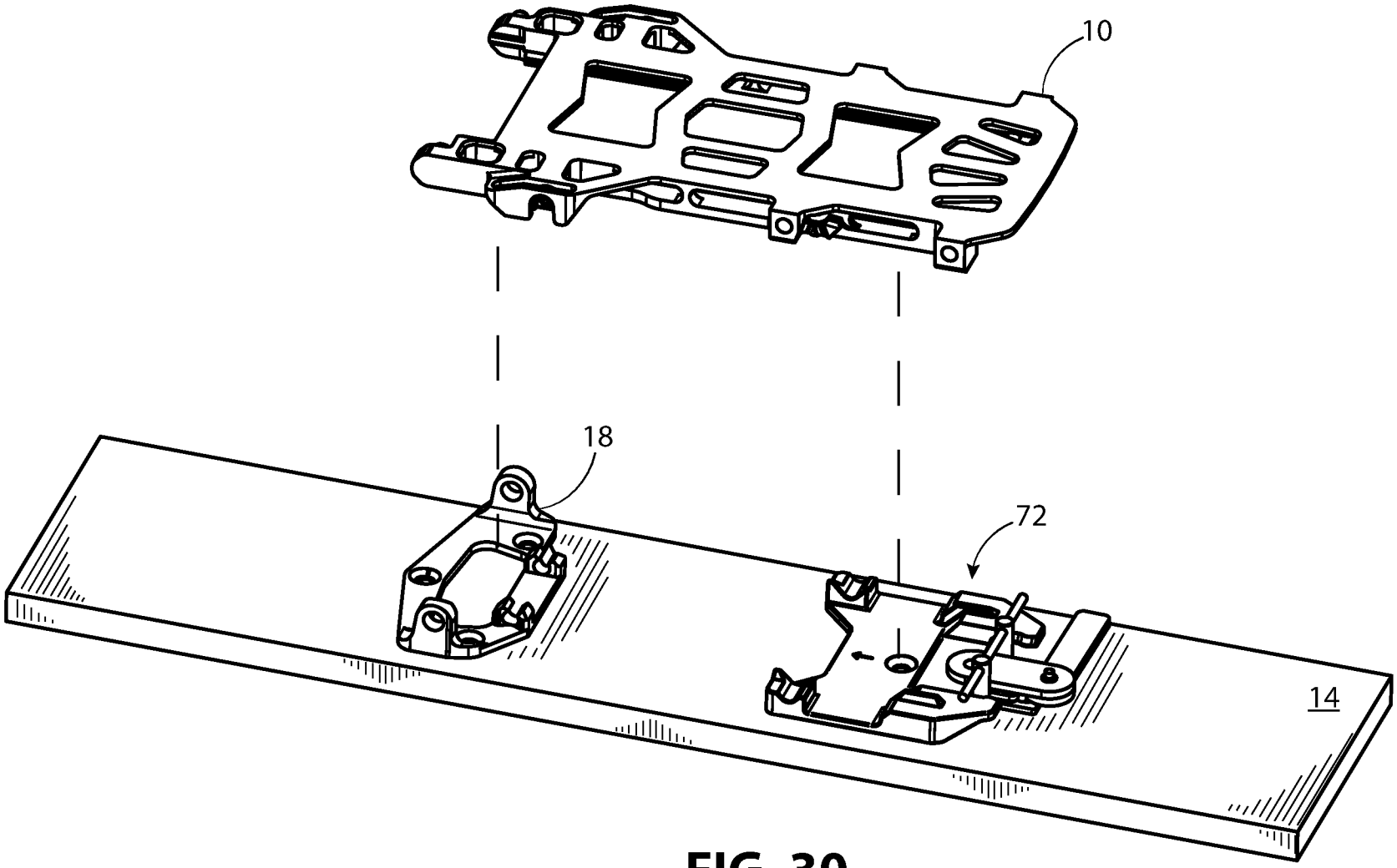
FIG. 30 illustrates, a partially exploded perspective view of FIG. 28 showing the boot binding baseplate exploded away from the splitboard, locking assembly, and mounting bracket.
Figure 31:
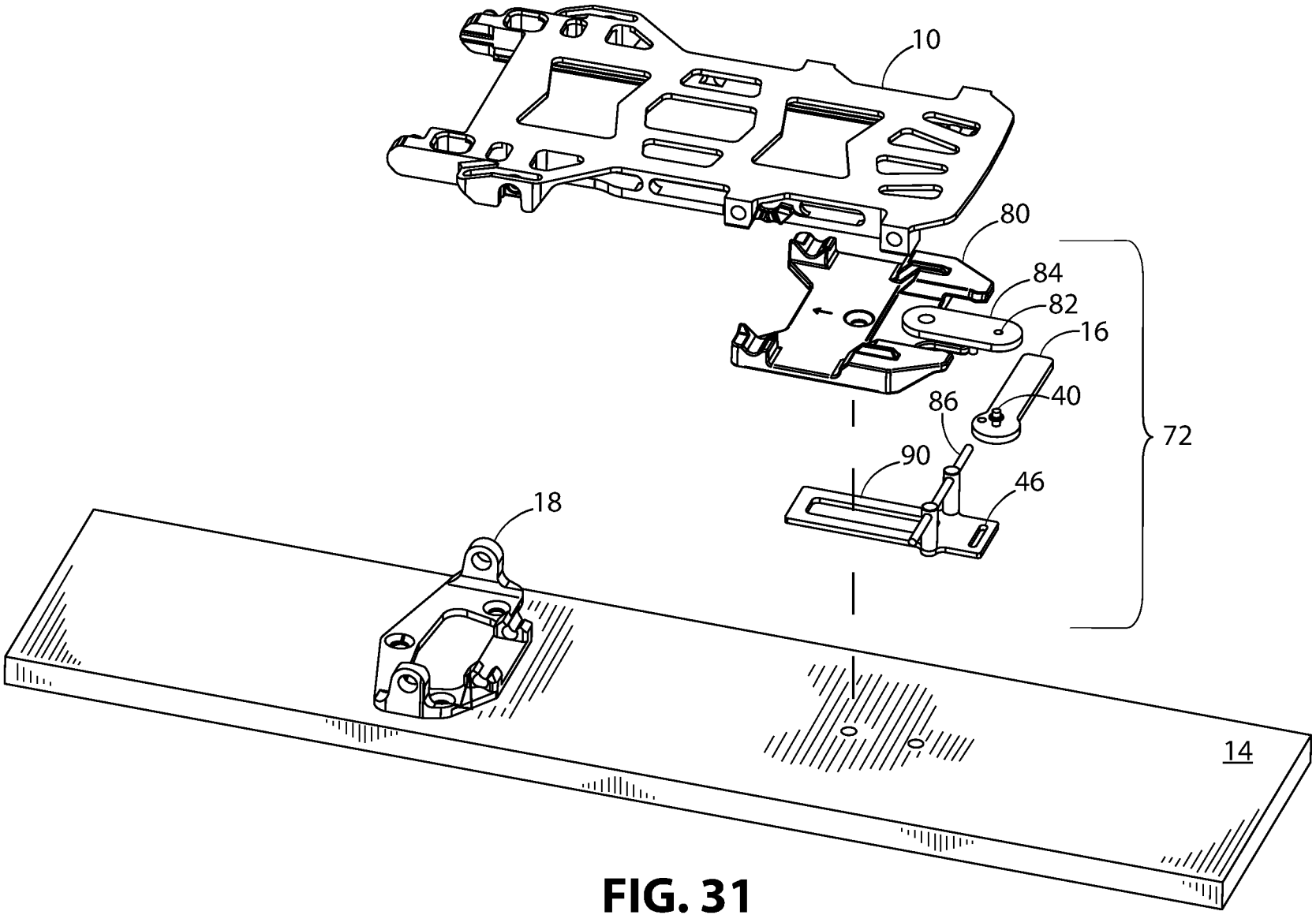
FIG. 31 illustrates, a partially exploded perspective view of FIG. 28 showing, the boot binding base, slotted bracket, bracket, lever, and heel rest, exploded away from the heel-locking assembly.

FIGS. 28-31 illustrate another example of a heel-locking assembly 72. FIGS. 28-31 showing the boot binding baseplate 10 (except FIG. 29), the heel-locking assembly 72 and a portion of a splitboard ski 14. FIG. 29 illustrates the assembly of FIG. 28 with the boot binding baseplate 10 removed to reveal the heel-locking assembly 72 and a mounting bracket 18. FIG. 30 illustrates, a partially exploded perspective view of FIG. 28 showing the boot binding baseplate 10 exploded away from the splitboard ski 14, heel-locking assembly 72, and mounting bracket 18. FIG. 31 illustrates, a partially exploded perspective view of FIG. 28 showing, the boot binding baseplate 10, lever 16, slotted bracket 90 and heel rest 80, exploded away from the heel-locking assembly 72. The mounting bracket 18 is illustrated attached to the splitboard ski 14. The operation of the heel-locking assembly 72 is like the heel-locking assembly 12 described for FIGS. 1-23. A pin 40 that projects upward from the lever 16 engages an aperture 82 in a bracket 84 projecting from the heel rest 80. A pin 44 that projects downward, and is partially hidden from view, engages a pin-engaging slot 46 that runs laterally across the bracket 84. Instead of the lock bar 24 of FIGS. 1-23 the heel-locking assembly 72 uses a cylindrical member 86 such as a wire or a thin pipe or tube.

Figure 32:
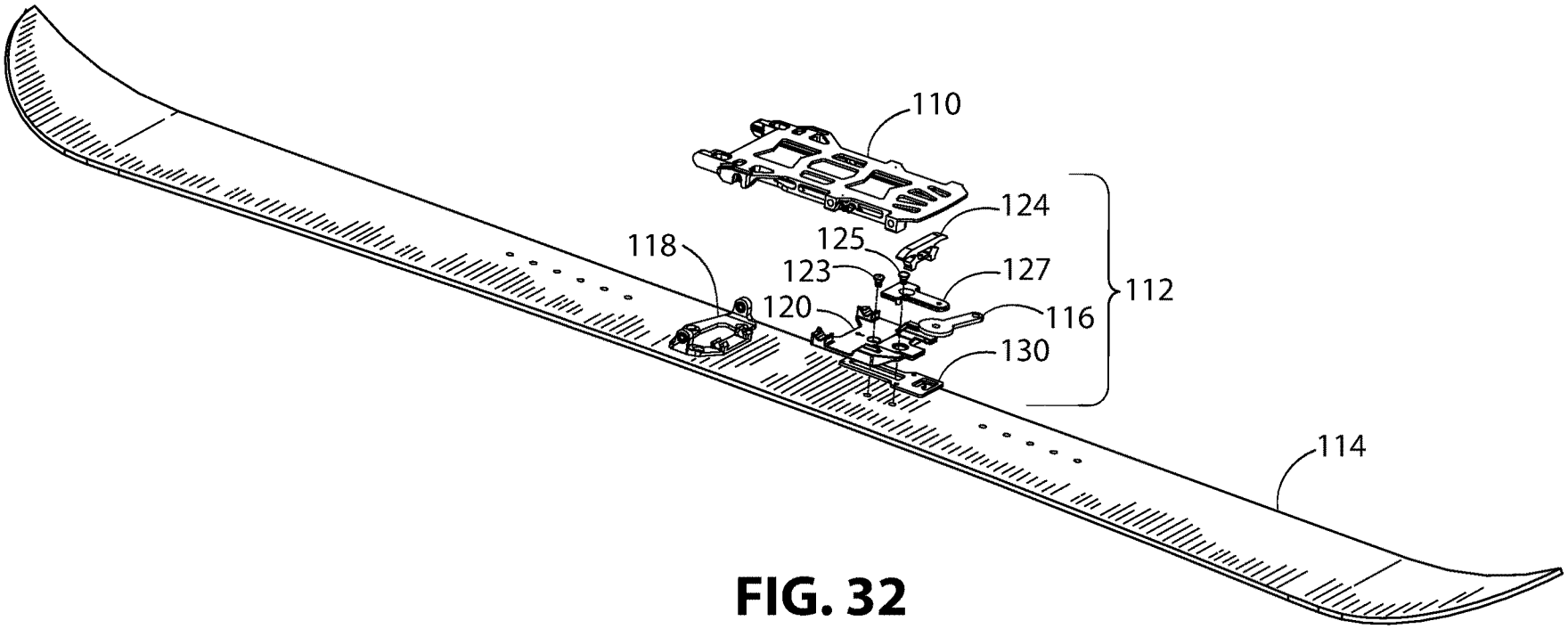
FIG. 32 illustrates a top, exploded, and perspective view of an additional embodiment of a boot binding baseplate with a heel-locking assembly attached to a splitboard ski.
Figure 33:
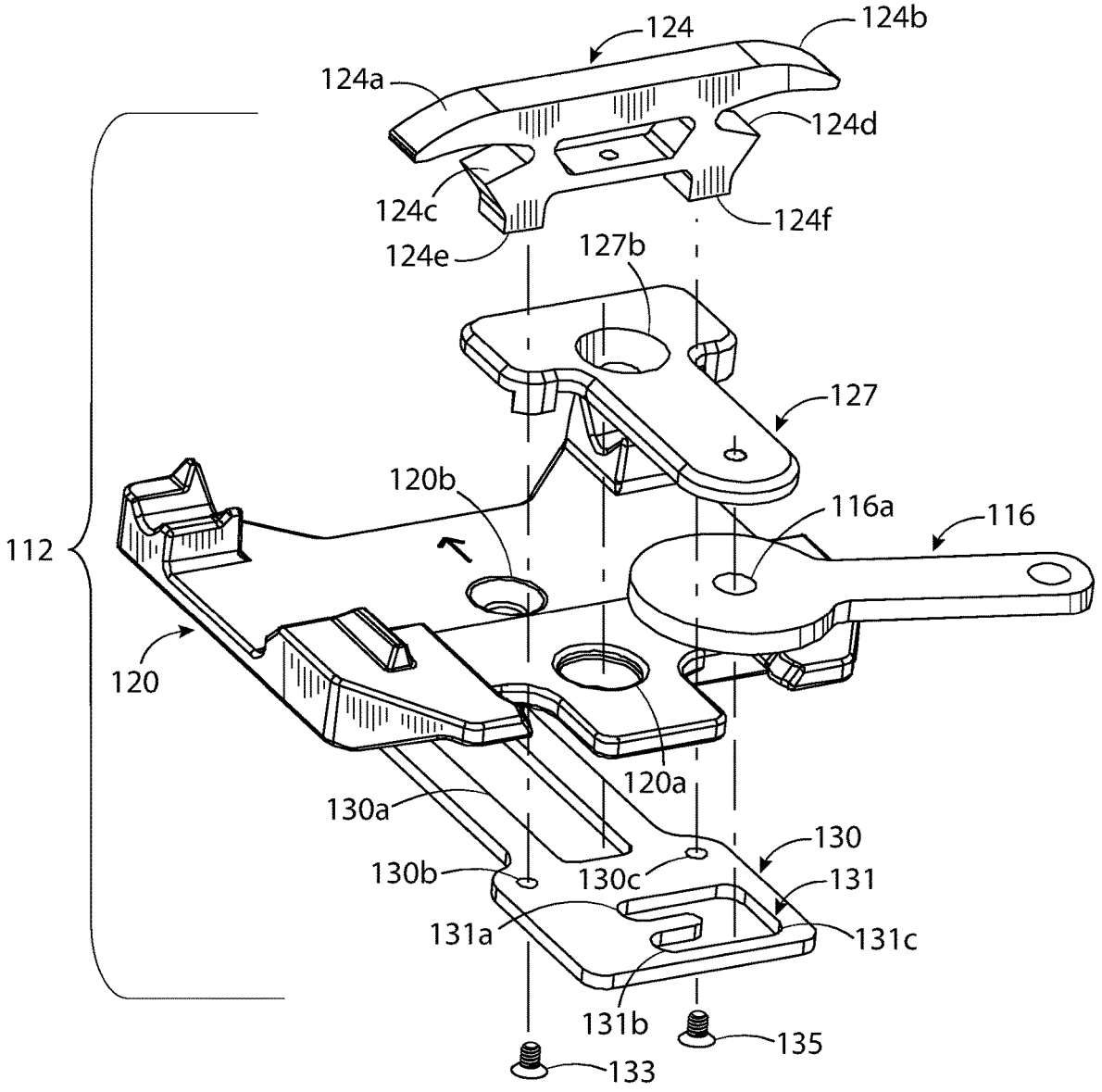
FIG. 33 illustrates a top, exploded, and perspective view of the heel-locking assembly of FIG. 32.
Figure 34:
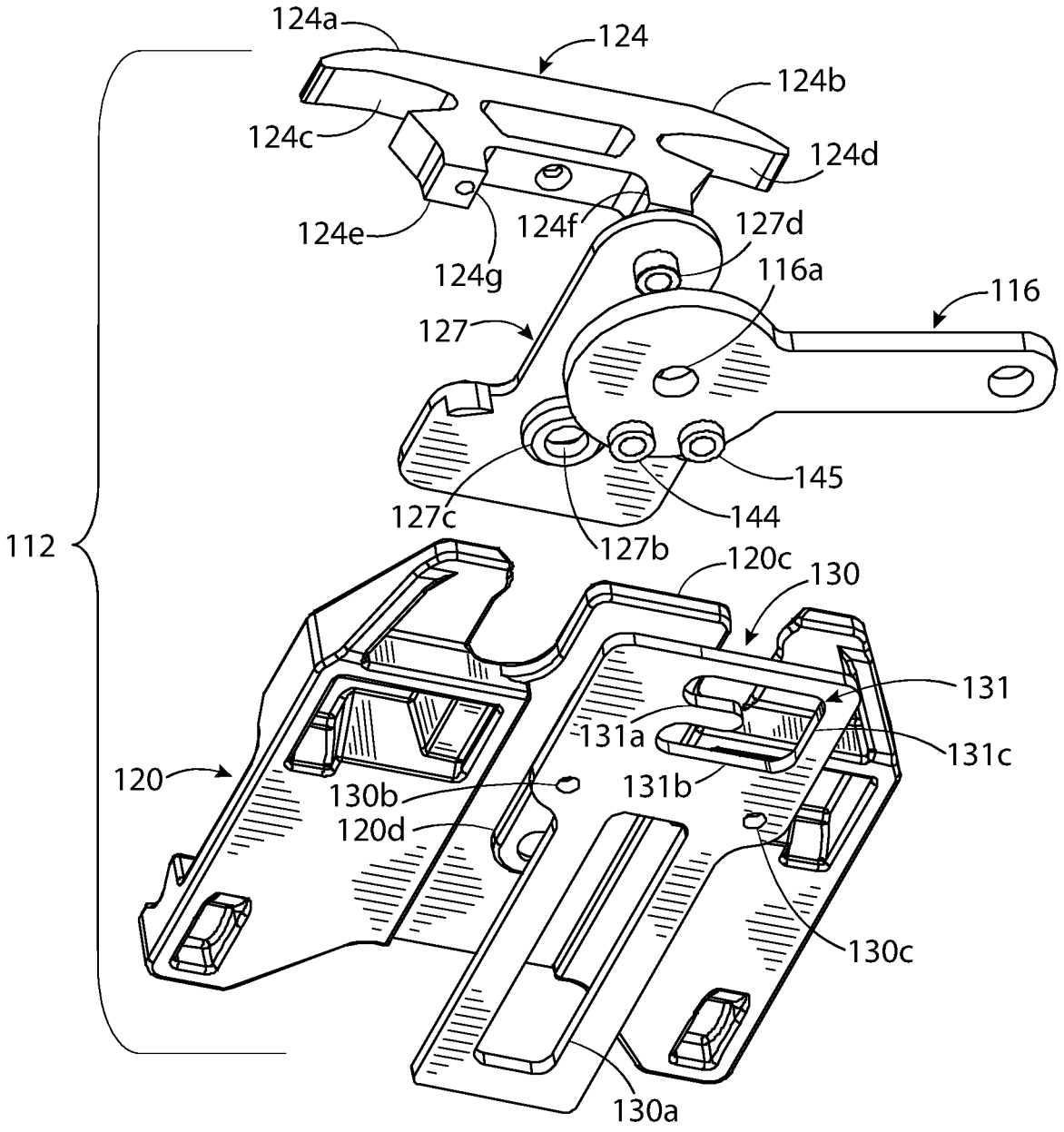
FIG. 34 illustrates a bottom, exploded, and perspective view of the heel-locking assembly of FIG. 32.

While the inventor was field testing the heel-locking assembly 12 of FIGS. 1-23, he noted that it may be desirable to prevent the lock bar 24 or lever 16 of FIGS. 5, 6, and 8-17 from being bumped and moving out of either a locked or unlocked position. FIGS. 32-44 illustrate a heel-locking assembly 112 (FIGS. FIGS. 32-34) where the lever 116 or lock bar 124 can be bumped but remain in either a locked or unlocked position. FIG. 32 illustrates an exploded view of the heel-locking assembly 112, exploded away from a snow glide board 114, a boot binding baseplate 110, and a mounting bracket 118 for hingedly mounting the front of the boot binding baseplate 110 to the snow glide board 114. The snow glide board 114 is illustrated in the form of a splitboard ski. The heel-locking assembly 112 can include a lock bar 124, a lock plate 127, slotted bracket 130, a lever 116, and a heel rest 120. Referring to FIGS. 33 and 34, threaded fasteners 133, 135 (FIG. 33) secure the lock bar 124 to the slotted bracket 130 via apertures 130*b*, 130*c* in the slotted bracket 130 and apertures in the lock bar legs 124*e*, 124*f*. Aperture 124*g* in lock bar leg 124*e* is shown in FIG. 34. The lock bar 124 is illustrated with the lock bar legs 124*e*, 124*f* integrally formed with the rest of the lock bar 124. This eliminates the need for external spacers or standoffs, such as the spacers 28 of FIG. 6.

Referring to FIGS. 32-34, the heel-locking assembly 112 is secured to the snow glide board 114 of FIG. 32 by threaded fasteners 123, 125 (FIG. 32). Referring to FIGS. 33 and 34 threaded fastener 125 of FIG. 32 extends through aperture 127*b* of the lock plate 127, aperture 120*a* (FIG. 33) in the heel rest 120, and slot 130*a* in the slotted bracket 130. Threaded fastener 123 of FIG. 32 extends through aperture 120*b* (FIG. 33) of the heel rest 120. Referring to FIGS. 33 and 34, the aperture 120*a* extends through a lip 120*c* (FIG. 34) in the heel rest 120. The lip 120*c* is elevated above the snow glide board 114 of FIG. 32 to allow the slotted bracket 130 to captively slide. Referring to FIG. 34, the lever 116 includes an aperture 116*a* that engages a pin 127*d* that projects downward from the lock plate 127. A first pin and a second pin, pins 144, 145 project downward from the lever 116 and into a pin-engaging slot 131 of the slotted bracket 130. The pin-engaging slot 131 is formed from two parallel slots joined at one end to form a c-shape. The first slot of the parallel slots forms a first slot portion 131*a*. The second slot of the parallel slots forms a second slot portion 131*b*. The first slot portion 131*a* and the second slot portion 131*b* are joined together by a third slot portion 131*c*. The third slot portion is illustrated cutting perpendicularly across the first slot portion 131*a* and the second slot portion 131*b*. As the lever 116 turns, the pins 144, 145 engage various portions of the pin-engaging slot 131. Because the pins 144, 145 are offset (i.e., not in the center of the axis of rotation like pin 127*d*), as they move through various portions of the pin-engaging slot 131, they can push or pull the slotted bracket 130. Because the slotted bracket 130 and the lock bar 124 are rigidly connected, both the slotted bracket 130 and the lock bar 124 will move as the lever 116 is turned. As the slotted bracket 130 moves, slot 130*a* slidably moves along opposing lengthwise sides of an elongated boss 120*d* that projects outward from the bottom of the heel rest 120. The elongated boss 120*d* is illustrated with opposing lengthwise sides that are parallel to each other and opposing ends that are rounded. The elongated boss 120*d* is shown integrally formed with the heel rest 120. Alternatively, the elongated boss 120*d* can be a separate component that is rigidly attached to the heel rest 120. The opposing ends could alternatively be parallel to the opposing ends of slot 130*a* with a radius between the ends and sides that is greater than or equal to the radius between the ends and sides of the 130*a*. At least a portion of the pin-engaging slot 131 is positioned transverse to the direction of slidable engagement between the slotted bracket 130 and the heel rest 120. For example, the first slot portion 131*a* and the second slot portion 131*b* is positioned transverse to the direction of slidable engagement between the slotted bracket 130 and the heel rest 120. Similarly, the lengthwise axis of the lock bar 124 can be positioned transverse to the direction of slidable engagement between the slotted bracket 130 and the heel rest 120.

Figure 35:
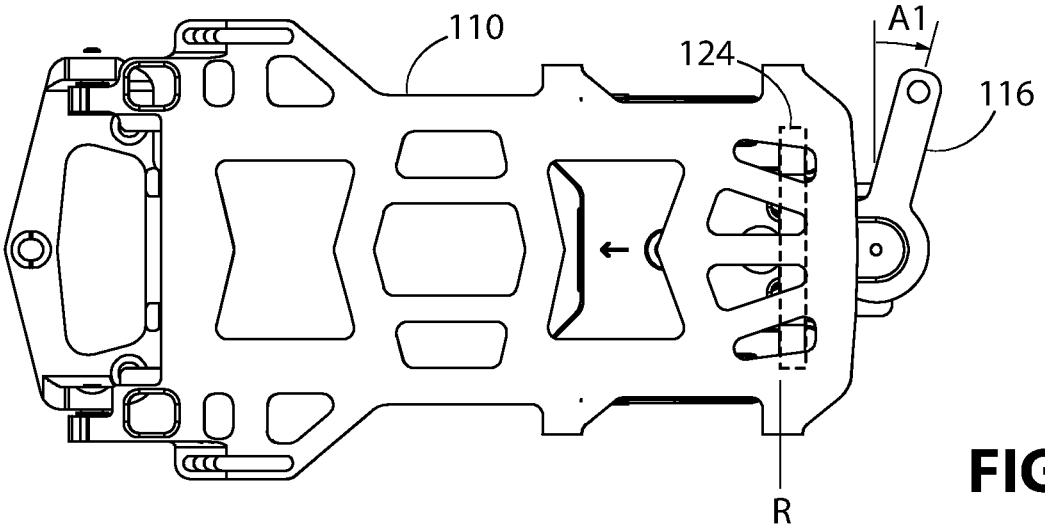
FIG. 35 illustrates in top view, the boot binding baseplate with the heel-locking assembly of FIG. 32, where the lever is rotated fully counterclockwise and the lock bar is in a locked position.
Figure 36:
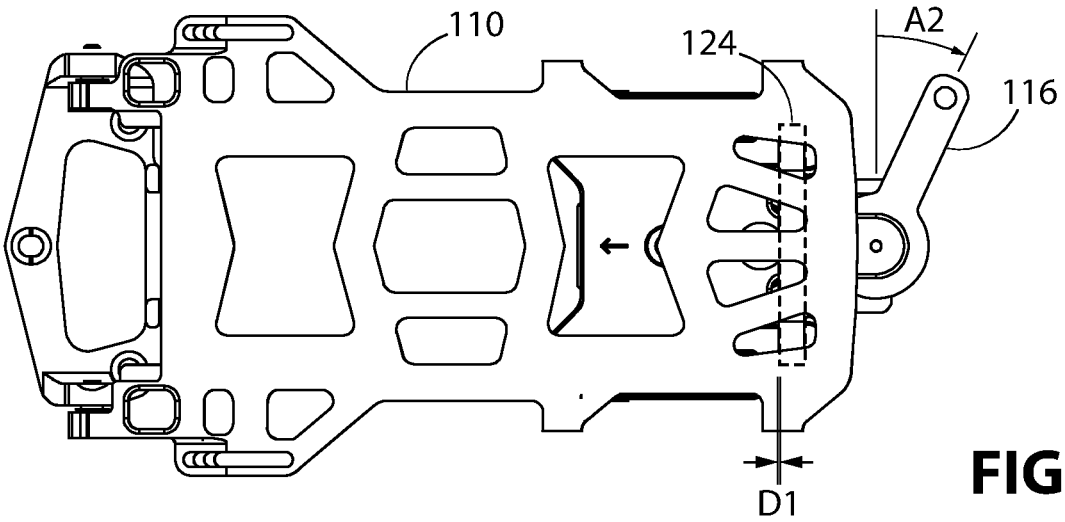
FIG. 36 illustrates, in top view, the boot binding baseplate assembly and the heel-locking assembly of FIG. 32, with the lever rotated to angle A2 with respect to the lengthwise line through the lock bar, and the lock bar in its most forward position.
Figure 37:
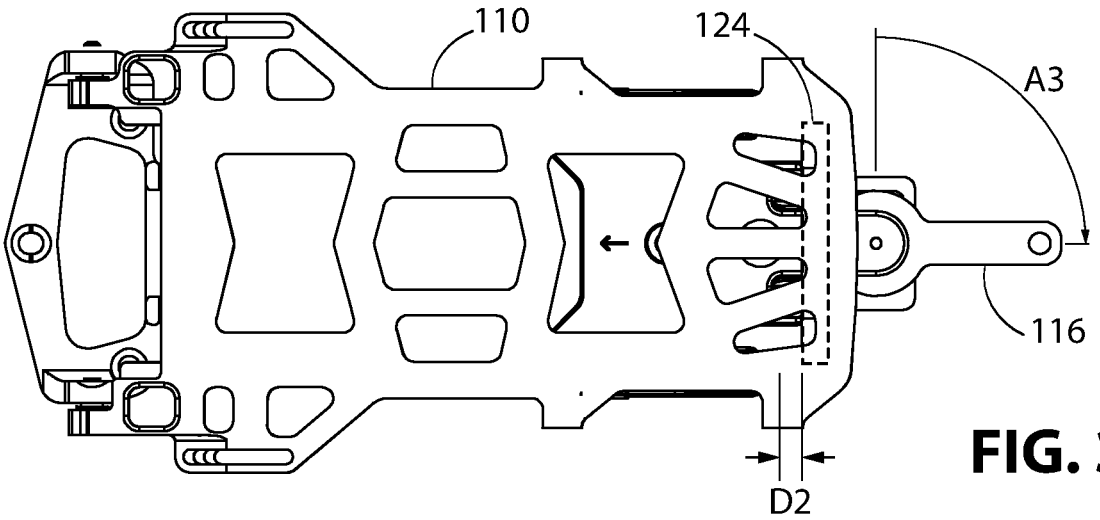
FIG. 37 illustrates, in top view, the boot binding baseplate and the heel-locking assembly of FIG. 32, in an unlocked position, with the lever rotated to angle A3 with respect to the lengthwise line through the lock bar.
Figure 38:
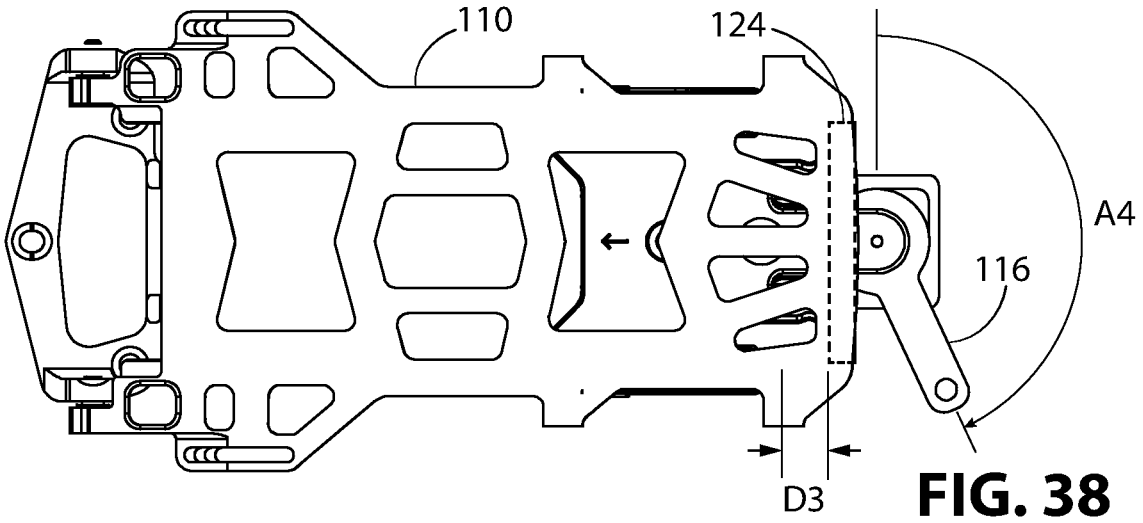
FIG. 38 illustrates in top view, the boot binding baseplate and the heel-locking assembly of FIG. 32, in an unlocked position, with the lock bar in its most rearward position and with the lever rotated to angle A4.
Figure 39:
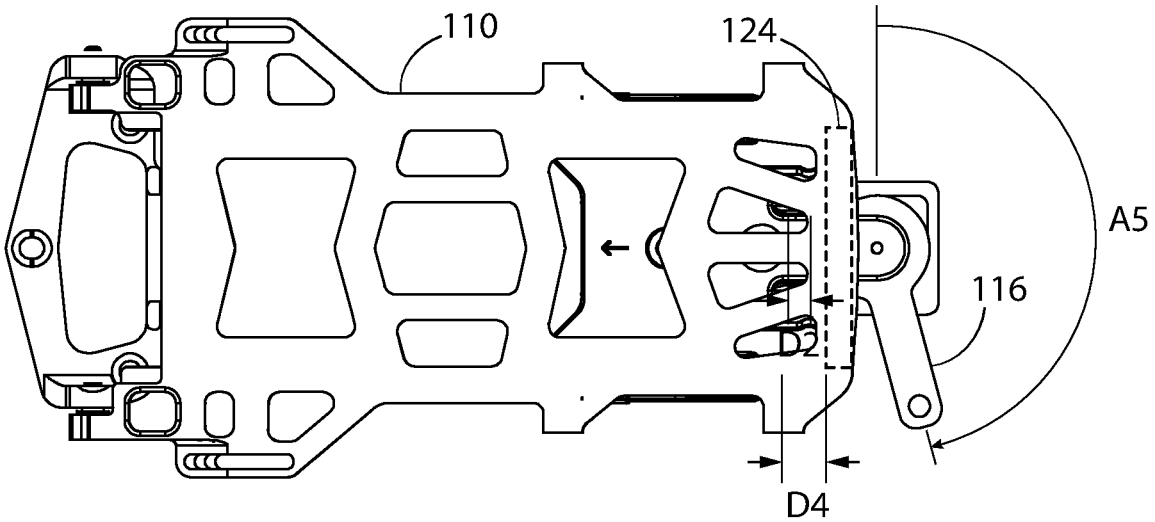
FIG. 39 illustrates in top view, the boot binding baseplate and the heel-locking assembly of FIG. 32, in an unlocked position, with the lever rotated to its most clockwise position.

FIGS. 35-39 illustrate, in top view, the relationship between movement of the lever 116 and the position of the lock bar 124 in relationship to the boot binding baseplate 110 as the lever 116 moves the lock bar 124 from the fully locked position in FIG. 35 to a fully unlocked position in FIG. 39. FIGS. 40-44 illustrate, in top view the position of the lever 116, in relation with the pin-engaging slot 131, pins 144, 145, and the lock bar 124, as the lever 116 moves the lock bar from the fully locked position in FIG. 40 to the fully unlocked position in FIG. 44. In FIGS. 35-39, and in FIGS. 40-44, the lever is shown being fully-rotatable between two end stops, from a first end in FIGS. 35 and 40 to a second end in FIGS. 39 and 44. The lock bar 124 is movable lengthwise along the boot binding baseplate 110 by rotation of the lever 116 thereby locking the boot binding baseplate 110 to the heel-locking assembly with the lever 116 being fully-rotated to a first end (FIGS. 39 and 44), the heel-locking assembly is locked to the boot binding baseplate 110 by the lock bar 124. The lever 116 has an increase in resistance to movement as it rotates away from the first end followed by a decrease in resistance to movement as it rotates toward the second end. In addition, as the lever 116 is rotated from the second end to the first end, the lever 116 has an increase in resistance to movement as it rotates away from the second end followed by a decrease in resistance to movement.

Referring to FIGS. 35-39, the lock bar 124 is shown in dashed lines representing that it is mostly hidden from view. Angles A1, A2, A3, A4, A5 in FIGS. 35, 36, 37, 38, and 39, respectively are referenced with respect to a lengthwise line through the lock bar 124. Starting from the fully locked position, at angle A1, in FIG. 35, lever 116 is rotated clockwise to angle A2 in FIG. 36, angle A3 in FIG. 37, angle A4 in FIG. 38, and to a fully unlocked position of angle A5 in FIG. 39. Angle A1 in FIG. 35 is illustrated as approximately 15°, angle A2 in FIG. 36 as approximately 25°, angle A3 in FIG. 37 as approximately 90°, angle A4 in FIG. 38 as approximately 155°, and angle A5 as approximately 165°. This represents a total rotational range of 150°. In FIG. 35, the back lengthwise edge of the lock bar 124 is positioned along line R. As the lever 116 turns clockwise, the lock bar 124 will ultimately more toward the back edge of the boot binding baseplate 110. In order to prevent movement of the bar or lever caused by accidental bumping, when the lever 116 rotates from angle A1 in FIG. 35 to angle A2 in FIG. 36, the lock bar will move slightly, a distance D1 from the reference line R of FIG. 25 away from the back edge of the boot binding baseplate 110. This will increase the locking force which will be explained in more detail when discussing FIGS. 40-44. In FIG. 37, the lever 116 is rotated to angle A3, the lock bar 124 moves a distance D2 from the reference line R of FIG. 35 toward the back edge of the boot binding baseplate 110. In FIG. 38 as the lever 116 is rotated to angle A4, the lock bar 124 moves to a distance D3 from the reference line R in FIG. 35. This position represents the maximum travel of lock bar 124 toward the back edge of the boot binding baseplate 110. In FIG. 39, as the lever is rotated to its final clockwise position represented by angle A5, the lock bar 124 moves slightly away from the back edge of the boot binding baseplate 110. The lock bar 124 is typically unlocked from the boot binding baseplate 110 at angle A3 (FIG. 37). The linear travel of the lock bar 124 toward the back of the boot binding baseplate 110 can be set so the lever 116 must be in a predetermined position for the boot binding baseplate to unlock for example, at some predetermined angle between angle A2 and angle A3. While the sequence illustrated goes from fully locked in the full counterclockwise position to fully unlocked in the full clockwise position, the heel-locking assembly 112 can be designed to operate in the opposite sequence (i.e., rotating counterclockwise unlocks rather than locks). For example, the snow glide board 114 is illustrated as a left splitboard ski. The sequence illustrated in FIGS. 35-39 is convenient for use on a left ski. The reverse sequence would typically be convenient for use on the right ski.

FIGS. 40-44 demonstrate in more detail how the locking mechanism works. FIGS. 40-44 illustrate, in top view, the heel-locking assembly 112 of FIGS. 35-39 with the boot binding baseplate 110 removed. FIGS. 40-44 show the relationship between lever 116, slotted bracket 130, pins 144, 145, pin-engaging slot 131, and lock bar 124 as the lever 116 goes through its range of motion. The combination slot includes the first slot portion 131*a*, the second slot portion 131*b*, and the third slot portion 131*c* structured as previously described for FIG. 34. The position of the lever 116 and lock bar 124 in FIG. 40 corresponds to the position of the lever 116 and the lock bar 124 in FIG. 35. Similarly, the position of the lever 116 and the lock bar 124 in FIGS. 41, 42, 43 and 44 corresponds to the position of the lever 116 and the lock bar 124 in FIGS. 36, 37, 38, and 39 respectively. Referring to FIGS. 40-44, the pin-engaging slot 131 and pins 144, 145 are hidden from view and represented by dashed lines.

Figure 40:
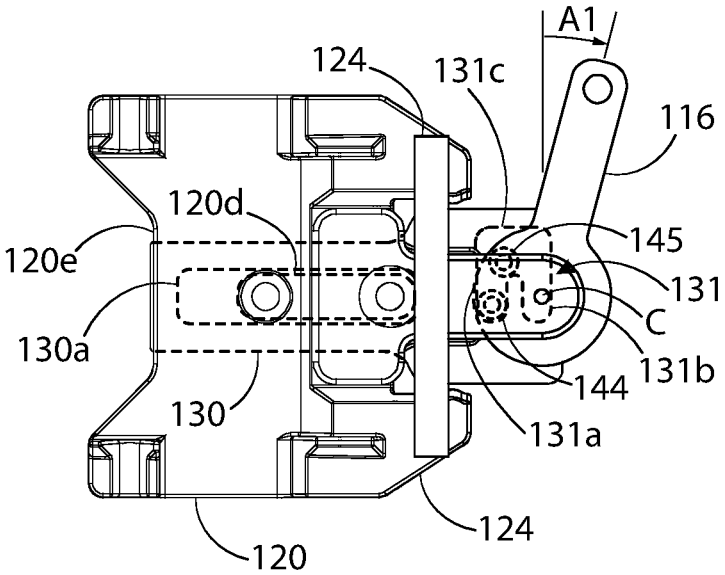
FIG. 40 illustrates, in top view of the heel-locking assembly of FIG. 35 with the boot binding baseplate removed.
Figure 41:
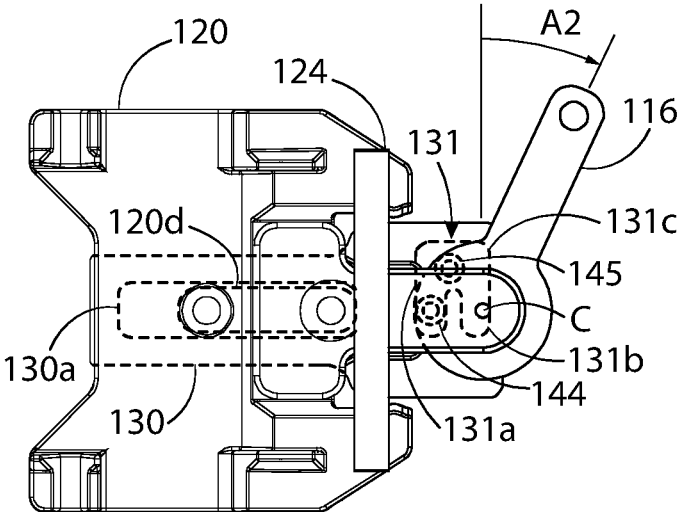
FIG. 41 illustrates in top view, the heel-locking assembly of FIG. 36 with the boot binding baseplate removed.

In FIG. 40, with the lever positioned at angle A1, pin 144 is engaged against the first slot portion 131*a*. Pin 144 presses against first slot portion 131*a* causing the slotted bracket 130 and the lock bar 124 to move forward toward the front edge 120*e* of the heel rest 120 and along the lengthwise axis of the heel rest 120 and the slotted bracket 130. Pin 145 is positioned within the third slot portion 127*c* but is not engaged. Because Pin 144 is positioned at the end of the first slot portion 131*a*, the lever 116 is at the limit of its counterclockwise rotation. In addition, a slot end of slot 130*a* slides against an elongated boss end of the elongated boss 120*d* nearest the lock bar 124. Pin 144 is positioned slightly left of the lengthwise axis of the slot 130*a* which also passes through the center of the axis of rotation C. The heel rest 120 can be formed from a material with structural strength and rigidity capable of withstanding splitboarding touring and riding activities in freezing weather conditions and at the same time have elastic qualities; for example, nylon. These elastic qualities create a spring force as the slot end of slot 130*a* is pushed forward against the elongated boss end of elongated boss 120*d*. In FIG. 41, the lever 116 is rotated to angle A2. In addition, if the lever 116 is also made of a material such as nylon with similar elastic properties, a spring force can be created between pin 144 and the first slot portion 131*a*. Pin 145 remains unengaged within the third slot portion 131*c*. Pin 144 is aligned along the lengthwise axis centerline of the slot 130*a* and therefore in the most rearward position with respect to the center of the axis of rotation C. This presses the slot 130*a* even harder against the end of the elongated boss 120*d* and creates additional spring force. In order for the lock bar 124 to be bumped rearward or the lever 116 to be bumped clockwise into an unlocked position, the greater spring force of FIG. 41 relative to the spring force of FIG. 40 would have to be overcome.

Figure 42:
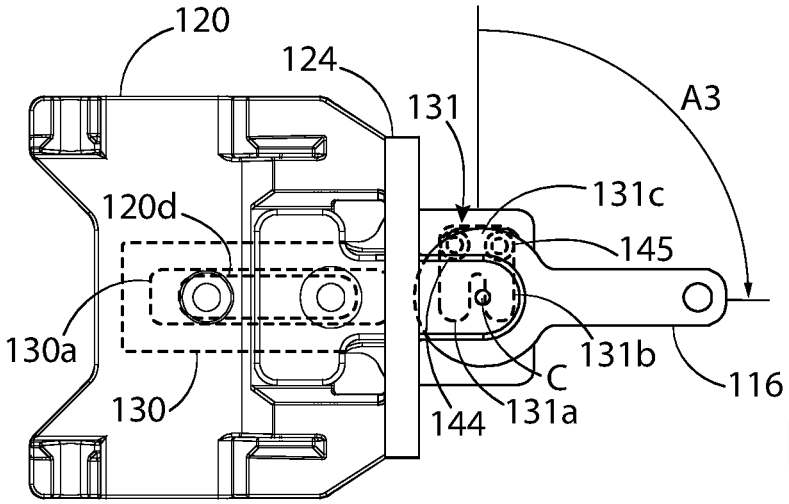
FIG. 42 illustrates in top view, the heel-locking assembly of FIG. 37 with the boot binding baseplate removed.

Referring to FIG. 42, with the lever rotated to angle A3, the pins 144, 145 are both within the third slot portion 131*c*. Angle A3 corresponds to halfway through the travel of the lever 116. The slot 130*a* is moved forward so the elongated boss 120*d* is located halfway between the ends of the slot 130*a*.

Figure 43:
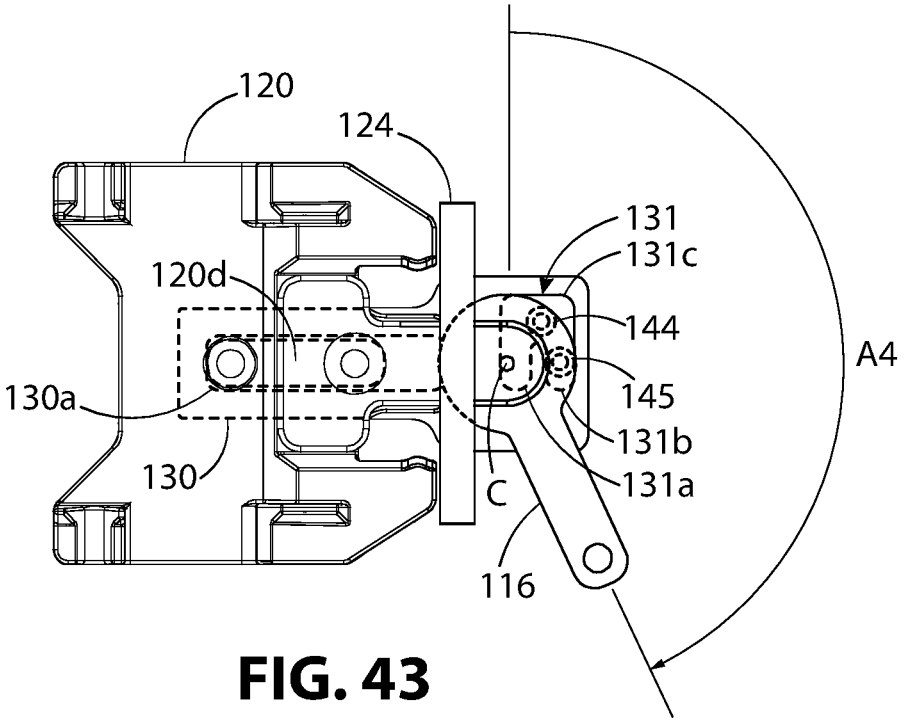
FIG. 43 illustrates in top view, the heel-locking assembly of FIG. 38 with the boot binding baseplate removed.

Referring to FIG. 43, as the lever is rotated to angle A4, pin 145 rotates into the second slot portion 131*b* and pin 144 is disengaged within the third slot portion 131*c*. The pin 144 is aligned along the lengthwise axis of the slot 130*a* and at its most rearward position with respect to the center of the axis of rotation C. This has the effect of pushing the slot 130*a* rearward with the forward-most slot end of the slot 130*a* pressing against the forward-most elongated boss end of the elongated boss 120*d*.

Figure 44:
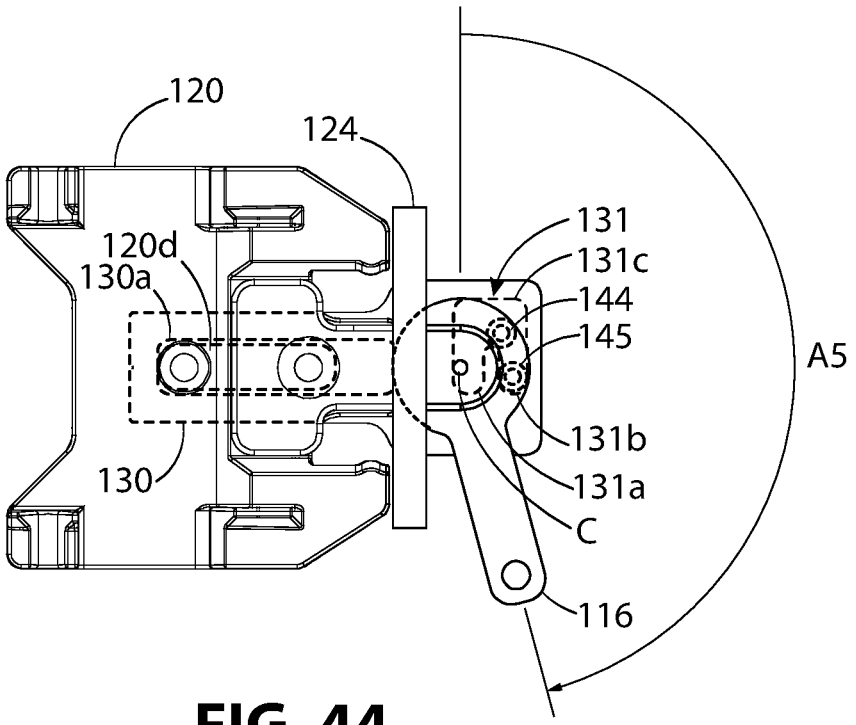
FIG. 44 illustrates in top view, the heel-locking assembly of FIG. 39 with the boot binding baseplate removed.

Referring to FIG. 44, as the lever 116 is rotated to its most clockwise position, pin 145 presses against the end of the second slot portion 131*b*, preventing further clockwise travel. Pin 144 remains unengaged within the third slot portion 131*c*. Pin 145 is no longer aligned along the lengthwise centerline of slot 130*a* and is moved to a position less rearward with respect to the center of the axis of rotation C. This moves the lock bar 124 slightly forward and relieves some of the spring tension. In order for the lock bar 124 to be bumped forward or the lever 116 to be bumped counterclockwise into a locked position, the greater spring force of FIG. 43 relative to the spring force of FIG. 44 would have to be overcome. If the lever 116 is also made of a material such as nylon with elastic properties as described, a spring force can be created between pin 145 and the second slot portion 131*b*.

The structure described for FIGS. 18-23 that allows the locking mechanism to engage by applying a downward force, can also be applied to the embodiment of FIGS. 32-44. Referring to FIG. 33, the lock bar 124 is structured so that the lock bar ends 124*a*, 124*b* deform under pressure. This can be accomplished by radiusing the lock bar ends 124*a*, 124*b*. The lock bar legs 124*e*, 124*f* optionally can be notched 124*c*, 124*d*. The lock bar 124 can alternatively be structured like lock bar 24 of FIGS. 21-24 with beveled ends or can be structured in any manner that would allow deformation of the ends under downward pressure. The lock bar 124 is made of a material, such as nylon or plastic, that flexes under pressure. As previously described, the boot binding baseplate 110 of FIGS. 35-39 is typically made of aluminum or other metal that is much stiffer and less flexible than the lock bar 124. Using the combination of lock bar 124 of FIGS. 32-34, and the structure previously described for FIGS. 21-24, the snow glide board rider can press down their heel on the heel end of the boot binding baseplate 110 of FIG. 32 with sufficient force to cause the lock bar 124 to slightly deform and cause the inwardly-flanged lip 10*b* of FIG. 23 to slip under the lock bar 124, causing the heel-locking assembly 112 (FIGS. 32-34) to lock to the boot binding baseplate 110 (FIG. 32).

A heel lock assembly for splitboards and other snow gliding boards has been described. This disclosure does not intend to limit the claimed invention to the examples, variations, and exemplary embodiments described in the Specification. Those skilled in the art will recognize that variations will occur when embodying the claimed invention in specific implementations and environments.

It is possible to implement certain features described in separate embodiments in combination within a single embodiment. For example, it is possible to adapt the pin-engaging slot 46, pin 44, and lever 16 in FIG. 6 so that the lever shown in FIGS. 8-12 and FIGS. 13-17 has a similar rotational range, start angle, and stop angle as shown in FIGS. 35-39 and FIGS. 40-44, respectively. Conversely, the pin-engaging slot 131, pins 144, 145, and lever 116 of FIGS. 35-39 and FIGS. 40-44 can be adapted to have a larger rotational range, for example, the 180° rotational range shown in FIGS. 8-12 and FIGS. 13-17. A person of ordinary skill in the art, upon reading the examples and examining the figures within this disclosure should be able to adjust the start angle, stop angle, and rotational range to suit their particular application.

It is possible to implement certain features described in single embodiments either separately or in combination in multiple embodiments. For example, the lever 116, pin-engaging slot 131, and the pins 144, 145 of FIG. 34 can be adapted for use in the first embodiment of FIGS. 1-23, the second embodiment of FIGS. 24-27, and the third embodiment of FIGS. 28-31. For example, in FIG. 6, lever 16 and pin 44 could be replaced with lever 116 and pins 144, 145 of FIG. 34, and pin-engaging slot 46 of slotted bracket 30 of FIG. 6 could be replaced with pin-engaging slot 131 of FIG. 33. In the embodiment of FIG. 27, pin-engaging slot 46 of slotted bracket 54 could be similarly replaced with pin-engaging slot 131 of FIG. 33. Lever 16 and pin 44 can be replaced with lever 116 and pins 44, 45 of FIG. 34. In the embodiment of FIG. 31 pin-engaging slot 46 of slotted bracket 90 can be replaced with pin-engaging slot 131 of FIG. 33. Lever 16 and pin 44 can be replaced by lever 116 and pins 144, 145 of FIG. 34.

In another example, the lock bar 124 of FIGS. 33 and 34, is shown secured directly to the slotted bracket 130. Lock bar 124 could be adapted for use in FIGS. 5 and 6, replacing the lock bar 24 and eliminating the need for spacers 28.

It is possible to combine certain features for the sake of manufacturability, cost, reliability, or other reasons. For example, the lock bar 124 and slotted bracket 130 of FIGS. 33 and 34 can be combined into a single part. The slotted bracket and lock bar 124 could be integrated into one part by injection molding. Similarly, the lock bar 24, spacers 28, and slotted bracket 30 of FIG. 6 can be combined into one integrated part.

Referring to FIG. 34, the lock plate 127 and heel rest 120 could be combined or integrated. For example, the lock plate 127 could be eliminated by modifying the lip 120*c* of the heel rest 120 and integrating the pin 127*d* into the lip 120*c*. A similar modification could be performed to integrate the lock plate 26 and heel rest 20 of FIG. 6. Referring to FIG. 31, the bracket 84 could be directly integrated with the heel rest 80.

Referring to FIG. 27, the wings 56 project directly out of the slotted bracket 54. The wings 56, taken together, are also a lock bar, within the meaning of this disclosure. While the wings 56 are integrated with the slotted bracket 54, they could alternatively be separately attached. Analogously, the lock bar 24 of FIG. 6 or the lock bar 124 of FIG. 33 does not need to be linear. It can be u-shaped, or even wing-shaped. For example, the lock bars 24, 124 can be wing-shaped in a similar manner as the wings 56 in FIG. 27 and can either be integral with or separately attached to their respective slotted bracket 54, 130.

The inventor envisions that the variations described in the preceding paragraphs as well as other combinations described, fall within the scope of the claimed invention. For example, throughout the disclosure structures described as pins, for example, pin 40 of FIG. 6, pin 44 of FIGS. 13-17 and 27, and pin 127*d* of FIG. 34 can be projected portions that are integral with the corresponding structures they project out of. For example, pins 40, 44 can be molded, cast, or otherwise formed with lever 16. Pin 127*d* can be molded, cast, or otherwise formed with lock plate 127. Pins 144, 145 can be molded cast or otherwise formed with lever 116. Some or all of the pins 40, 44, 127*d*, 144, 145 can also be separately formed and secured by fasteners, adhesive, welded, swedged, press fit, or otherwise attached to the corresponding structures that they project out of. While the examples and variations are helpful to those skilled in the art in understanding the claimed invention, the claimed invention is defined by the claims and their equivalents.

The embodiments of FIGS. 1-44 where illustrated and discussed as applied to a splitboard. They can also be applied to other snow glide board structures such as snow skis or snowboards.

Any of the claims are not means-plus-function claims, unless a claim explicitly evokes the means-plus-function clause of 35 USC § 112(f) by using the phrase "means for" followed by a verb in gerund form. For example, "means for attaching."

"Optional" or "optionally" is used throughout this disclosure to describe features or structures that are optional. Not using the word optional or optionally to describe a feature or structure does not imply that the feature or structure is essential, necessary, or not optional. Using the word "or," as used in this disclosure is to be interpreted as the ordinary meaning of the word "or" (i.e., an inclusive or) For example, the phrase "A or B" can mean: (1) A, (2) B, (3) A with B. For example, if one were to say, "I will wear a waterproof jacket if it snows or rains," the meaning is that the person saying the phrase intends to wear a waterproof jacket if it rains alone, if it snows alone, if it rains and snows in combination.

What is claimed is:

1. A heel-locking device for locking a boot binding baseplate of a snow glide board, comprising:

a lever including a pin projecting directly from the lever and positioned rotationally eccentric with respect to the lever;

a heel rest secured to the snow glide board;

a slotted bracket that slidably engages the heel rest, the slotted bracket includes a pin-engaging slot at least partially positioned transverse to a direction of slidable engagement between the slotted bracket and the heel rest;

a lock bar secured to the slotted bracket; and the lever being rotated causes the pin to engage the pin-engaging slot thereby moving the slotted bracket and the lock bar in relation to the heel rest and securing the boot binding baseplate to the lock bar.

2. The heel-locking device of claim 1, wherein:

the lock bar includes a lengthwise axis transverse to the direction of slidable engagement.

3. The heel-locking device of claim 1, wherein:

the pin-engaging slot is linear and fully transverse to the direction of slidable engagement.

4. The heel-locking device of claim 1, wherein:

the pin-engaging slot includes a first slot portion;

a second slot portion parallel to the first slot portion and transverse to the direction of slidable engagement; and a third slot portion positioned transversely across the first slot portion and the second slot portion.

5. The heel-locking device of claim 4, wherein:

the pin is a first pin and a second pin; and the first pin is not positionable in the second slot portion and the second pin is not positionable in the first slot portion.

6. The heel-locking device of claim 1, wherein:

the slotted bracket includes a slot parallel to the direction of slidable engagement; and the heel rest includes an elongated boss, the slot being slidable along the elongated boss by rotation of the lever, a slot end engages and presses against an elongated boss end before the lever reaches its full rotational travel.

7. A device for locking a boot binding to a snow glide board, comprising:

a heel-locking assembly secured to the snow glide board;

a boot binding baseplate;

with a heel end of the boot binding baseplate being aligned over the heel-locking assembly, a downward force to the heel end of the boot binding baseplate causes the boot binding baseplate to lock to the heel-locking assembly and the snow glide board;

the heel-locking assembly includes a lever and a lock bar;

the lock bar is movable lengthwise along the boot binding baseplate by rotation of the lever; and with the lock bar being positioned under the boot binding baseplate but not locked, the downward force to the heel end causes the boot binding baseplate to lock the heel-locking assembly.

8. The device of claim 7, wherein:

the boot binding baseplate includes an inwardly-flanged lip projecting downward from the heel end; and the downward force to the heel end causes the lock bar to deform and the inwardly-flanged lip to slip under the lock bar thereby locking the heel-locking assembly to the boot binding baseplate.

9. The device of claim 7, wherein:

the lock bar is lengthwise transverse to its axis of movement along the boot binding baseplate.

10. The device of claim 7, wherein:

with the lock bar not being positioned under the boot binding baseplate and the boot binding baseplate resting against the heel-locking assembly, the boot binding baseplate is lockable to the heel-locking assembly by movement of the lock bar under the boot binding baseplate caused by rotation of the lever.

11. The device of claim 7, further including:

a slotted bracket secured to the lock bar;

the slotted bracket includes a pin-engaging slot at least partially transverse to a lengthwise axis of the boot binding baseplate;

the lever includes a pin projecting directly from the lever and positioned rotationally eccentric with respect to the lever; and rotation of the lever causes the pin to engage the pin-engaging slot thereby moving the slotted bracket and the lock bar in relation to the boot binding baseplate.

12. A heel-locking device for locking a boot binding baseplate of a snow glide board, comprising:

a heel-locking assembly including a lever and a lock bar;

the lock bar is movable lengthwise along the boot binding baseplate by rotation of the lever, the heel-locking assembly is locked to the boot binding baseplate by the lock bar with the lever being rotated toward a first end of rotation; and the lever has an increase in resistance to movement as it rotates away from the first end of rotation followed by a decrease in resistance to movement.

13. The heel-locking device of claim 12, wherein:

the lever being rotatable to a second end of rotation, the lever has an increase in resistance to movement as it rotates away from the second end of rotation followed by a decrease in resistance to movement.

14. The heel-locking device of claim 13, further including:

a slotted bracket secured to the lock bar, the slotted bracket including a pin-engaging slot;

the lever includes a pin projecting directly from the lever and positioned rotationally eccentric with respect to the lever; and the lever being rotated, causes the pin to engage the pin-engaging slot thereby moving the slotted bracket and the lock bar in relation to the boot binding baseplate.

15. The heel-locking device of claim 12, further including:

a slotted bracket secured to the lock bar, the slotted bracket including a pin-engaging slot;

the lever includes a pin projecting directly from the lever and positioned rotationally eccentric with respect to the lever; and the lever being rotated causes the pin to engage the pin-engaging slot thereby moving the slotted bracket and the lock bar in relation to the boot binding baseplate.

* * * * *